US007971325B2

(12) United States Patent
Line et al.

(10) Patent No.: US 7,971,325 B2
(45) Date of Patent: Jul. 5, 2011

(54) TOUCH FASTENER PRODUCTS

(75) Inventors: Kevin Keith Line, Port Severn (CA); Stephane Xavier Girard, Toronto (CA); David Pubrat, Ontario (CA); Daniel Lee Janzen, Brampton (CA); Michael Cina, Etobicoke (CA); Kristel L. Ferry, Golden, CO (US); Mark A. Clarner, Concord, NH (US); David P. Kraus, Jr., Amherst, NH (US)

(73) Assignee: Velcro Industries B.V., Curacao ( * ) Notice: Subject to any disclaimer, the term of this patent is extended or adjusted under 35 U.S.C. 154(b) by 782 days.

(21) Appl. No.: 11/873,664

(22) Filed: Oct. 17, 2007

(65) Prior Publication Data

US 2008/0092348 A1 Apr. 24, 2008

Related U.S. Application Data

(60) Provisional application No. 60/829,836, filed on Oct. 17, 2006, provisional application No. 60/829,996, filed on Oct. 18, 2006.

(51) Int. Cl.
*A44B 18/00* (2006.01)

(52) U.S. Cl. ..... 24/442; 428/100

(58) Field of Classification Search ..... 24/442, 24/306, 452, 450; 428/100
See application file for complete search history.

(56) References Cited

U.S. PATENT DOCUMENTS

| | | | |
|---|---|---|---|
| 3,717,908 | A | 2/1973 | Perina |
| 5,518,795 | A | 5/1996 | Kennedy et al. |
| 6,656,563 | B1 | 12/2003 | Leach et al. |
| 6,803,010 | B2 | 10/2004 | Leach et al. |
| 2004/0108620 | A1 | 6/2004 | Leach et al. |
| 2005/0196599 | A1 | 9/2005 | Line et al. |

OTHER PUBLICATIONS

International Search Report from foreign patent office in counterpart application PCT/US2007/081612, dated Sep. 25, 2008.

*Primary Examiner* — James R Brittain
(74) *Attorney, Agent, or Firm* — Fish & Richardson P.C.

(57) ABSTRACT

A touch fastener including an elongated base having multiple segments connected by articulable joints. Each segment has an upper surface, a lower surface, and a plurality of touch fastener elements extending from the lower surface of the base. A flexible barrier extends across at least one articulable joint between adjacent base segments. The fastener may include a magnetically attractable material disposed along a center region of the upper surface of the base. The fastener base may define a pair of first and second notches in opposite longitudinal edges of the base at the articulable joint to allow bending of the base. The base may also define a slit extending through the base from a longitudinal edge thereof at the articulable joint.

15 Claims, 21 Drawing Sheets

TOUCH FASTENER PRODUCTS

CROSS-REFERENCE TO RELATED APPLICATIONS

This U.S. patent application claims priority under 35 U.S.C. §119(e) to U.S. Provisional Application 60/829,836, filed on Oct. 17, 2006 and U.S. Provisional Application 60/829,996, filed on Oct. 18, 2006. The disclosures of the aforementioned prior applications are hereby incorporated by reference in their entireties and are therefore considered part of the disclosure of this application.

TECHNICAL FIELD

This invention relates to touch fastener products as mold inserts, such as in the molding of seat foam buns and the like.

BACKGROUND

Seats for cars and light trucks have been formed by molding a foam bun that will serve as the seat cushion, and then attaching a pre-stitched fabric cover to the foam bun. Often, the fabric cover is attached to the foam bun by insert molding touch fastener products into the outer surface of the foam bun and attaching cooperating touch fastener products to an inner surface of the fabric cover. Generally, the fastener products are attached to the fabric cover along the seams where the cover is stitched together and held in place by the seam stitching. The touch fastener products allow the seat manufacturer to rapidly and semi-permanently attach the fabric cover to the foam bun by pulling the fabric cover over the foam bun and pressing the opposed touch fastener products on the foam bun and fabric cover together.

In general, the touch fastener products can be secured to the seat foam bun during a molding process, such as by holding the fastener products magnetically against a side of the mold cavity in which the foam bun is molded. During this molding process, care must be taken to avoid fouling of the fastener elements with the liquid foamable composition used to form the seat. Fouling can occur if the liquid foaming composition leaks between the edges of the base of the touch fastener product and the mold surface into the space between the fastener elements (e.g., hooks).

SUMMARY

In one aspect, a touch fastener product includes an elongated base having multiple segments connected by articulable joints. Each segment has upper and lower surfaces and a plurality of touch fastener elements extending from the lower surface of the base. A flexible barrier extends across at least one articulable joint between adjacent base segments.

In another aspect, a touch fastener includes an elongated base having upper and lower surfaces and a plurality of touch fastener elements extending from the lower surface of the base. The base defines a series of spaced apart pairs of opposite notches in its longitudinal edges, forming respective articulable base joints. Adjacent pairs of notches define respective base segments between them. The notches are each sized with respect to an overall width of the base such that, when one of the articulable joints is flexed to close one of its corresponding notches, the other of its corresponding notches opens only to a longitudinal gap dimension less than about 0.5 millimeter. The fastener may also include a flexible barrier, such as a film, extending across at least one articulable joint between adjacent base segments.

The articulable joints may be spaced closer together along some regions of the base than along other regions of the base to allow greater curvature of the touch fastener. Generally, the articulable joints may have a longitudinal joint spacing of between about 5 and 50 millimeters.

The fastener may also include a magnetically attractable material disposed along a center region of the upper surface of the base. The magnetically attractable material may be discontinuous over the length of the touch fastener. In one example, the width of the magnetically attractable material is less than about 25% of the width of the base. In another example, the width of the magnetically attractive material is less than about 10% of the width of the base. In yet another example, the width of the magnetically attractable material is less than about 5% of the width of the base.

The magnetically attractive material may comprise iron particles, which can be fused together to form a cylindrical shape having a diameter between about 0.4 mm and 3.5 mm. The cylindrical shape of fused iron particles extends across the length of the base.

In one example, the magnetically attractable material is a metallic wire which may extend across at least one of the articulable joints. The wire is secured to the upper surface of the base by resin, in one example. In another example, the magnetically attractable material is secured to the upper surface of at least one base segment in at least one location along the base segment, allowing the magnetically attractable material to move at other locations.

The barrier may be a film which may be secured by an adhesive, such as a polyurethane hot melt. The film may be a polyamide or polyurethane as well. The film has a nominal thickness of less than about 0.002 inch. In another example, the film has a nominal thickness of less than about 0.010 inch. In some examples, the film has a flexural rigidity of about 1800 mg-cm; and a tensile stiffness of between about 1000 and about 3000 mg-cm.

In some examples, the barrier is wider than the base, such that the barrier extends beyond longitudinal edges of the base. In one example, the barrier extends beyond longitudinal edges of the base at the joints. The barrier material may also be more flexible than the base and may comprise an elastomeric material.

The fastener base may define a pair of first and second notches in opposite longitudinal edges of the base at the articulable joint to allow the approximation of a curve in the base. The notches extend completely through the base. In some examples, each notch defines a longitudinal gap dimension of less than about 0.25 and a notch angle of between about 2 and 90 degrees between opposing base surfaces. In one example, the base edges in the first and second notches are bent in opposing directions to allow the base edges to overlap when the joint is bent.

The base may also define a slit extending through the base from a longitudinal edge thereof at the articulable joint. In one example, the barrier defines a slit in through a longitudinal edge of the flexible barrier and aligned with one of the notches at the articulable joint. The slit can extend across a majority of a lateral width of the base. In another example, the base defines a notch extending from a longitudinal edge of the base opposite the slit.

The fastener base may include multiple discrete barrier segments, such that each barrier segment extends across at least one respective articulable joint. Each barrier segment may be secured to longitudinal center portions of two adjoining base segments; to only one of the two adjacent base segments defining its respective articulable joint; or both.

A flexible compressible gasket may be secured to the lower surface of the base. The gasket extends across at least one articulable joint to impede foam intrusion during a molding process. In one example, the barrier material is a flexible compressible gasket.

The adjacent base segments of the fastener can also be joined at rotatable pivots at the articulable joints. In one example, adjacent base segments are joined at the articulable joints by a link at two rotatable pivots. Similarly, adjacent base segments can also be joined at articulable joints by a single rotatable pivot.

A method of making a touch fastener includes continuously introducing a flexible substrate to a gap formed along a peripheral surface of a rotating mold roll. Another step includes introducing molten resin to the gap between the substrate and the peripheral surface of the mold roll, such that the resin at least partially fills an array of cavities defined in the rotating mold roll to form resin stems while a base of resin interconnecting the stems is laminated to the substrate on the peripheral surface of the roll. Additional steps include forming engageable heads on the stems and forming longitudinally spaced apart discontinuities in the base to provide articulable joints between adjacent base segments, across which the substrate extends.

The discontinuities may be formed by introducing the resin to the gap in longitudinally spaced apart quantities defining gaps between them. In another instance, the discontinuities are formed after the resin base is stripped from the mold roll. The heads are formed by molding the heads with the stems in the cavities.

The step of forming articulable joints my also include forming a pair of first and second notches in opposite longitudinal edges of the base at the articulable joint. The notches may extend completely through the base. In some examples, the notches each define a longitudinal gap dimension of less than about 0.25 inches and include a notch angle of between about 2 and 90 degrees between opposing base surfaces.

The method may also include a step of forming a slit extending through the base from a longitudinal edge thereof at the articulable joint. The slit may extend across a majority of a lateral width of the base. A notch may also be formed that extends from a longitudinal edge of the base opposite the slit.

During the step of forming the articulable joints, the joints may be formed closer together along some regions of the base than along other regions of the base to provide the ability to approximate greater curves. The joints may also be formed with a longitudinal joint spacing of between about 5 and 50 millimeters.

The method may include an additional step of securing a flexible barrier material, such as a film, to the base, such that the barrier material extends across at least one articulable joint between adjacent base segments. The barrier may define or have formed in it a slit in through a longitudinal edge of the flexible barrier and aligned with one of the notches at the articulable joint. In one example, the barrier defines two slits through opposite longitudinal edges of the barrier and aligned with the first and second notches of the base. The barrier material is wider than the base, such that the barrier material extends beyond longitudinal edges of the base. The barrier material may also be more flexible than the base and may comprise an elastomeric material.

The method may include an additional step of securing multiple discrete barrier segments, such that each barrier segment extends across at least one respective articulable joint. Each barrier segment may be secured to longitudinal center portions of two adjoining base segments; to only one of the two adjacent base segments defining its respective articulable joint; or both.

Additionally, the method may include the step of disposing a magnetically attractable material, such as a metallic wire, along a center region of an upper surface of the base. The magnetically attractable material extends across at least one of the articulable joints and may be severed at the joints to provide greater freedom of motion. The magnetically attractable material is secured to the upper surface of at least one base segment in at least one location along the base segment, allowing the magnetically attractable material to move at other locations. Segments of magnetically attractable material may be disposed along a center region of an upper surface of the base, between the articulable joints.

Another step includes disposing a fabric patch over at least one articulable joint.

Yet another step includes securing a compressible gasket to a lower surface of the base. The gasket extends across at least one articulable joint to impede foam intrusion during a molding process.

The method may include an additional step of forming rotatable pivots to join adjacent base segments at the articulable joints.

A method of forming a seat foam bun includes providing a mold cavity having a shape corresponding to the shape of the seat foam bun. The mold cavity defines a trench. Another step includes providing a touch fastener that includes an elongated base having multiple segments connected by articulable joints. Each segment has upper and lower surfaces and a plurality of touch fastener elements extending from the lower surface of the base. A flexible barrier extends across at least one articulable joint between adjacent base segments. Another step includes positioning the touch fastener along the trench with the flexible barrier in contact with a surface of the mold cavity. In yet another step, a foamable resin is delivered into the mold cavity to form a seat foam bun, while the flexible barrier resists intrusion of foamable resin into the plurality of touch fastener elements at the joints.

The various implementations and examples disclosed herein can provide an easy means of configuring a touch fastener product to follow a curved path in a molding process. Current methods employ short parts of touch fastener product placed individually to approximate a curve. Consequently, there are considerable areas along the curve with no available fastener elements, such as between parts and at end gaskets. The examples of notched touch fastener products disclosed herein may provide more continuous regions of available fastener elements. Furthermore, the use of barriers, as shown in the examples, may reduce foam intrusion during a molding process, thus increasing the amount of available fastener elements.

The details of one or more implementations of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
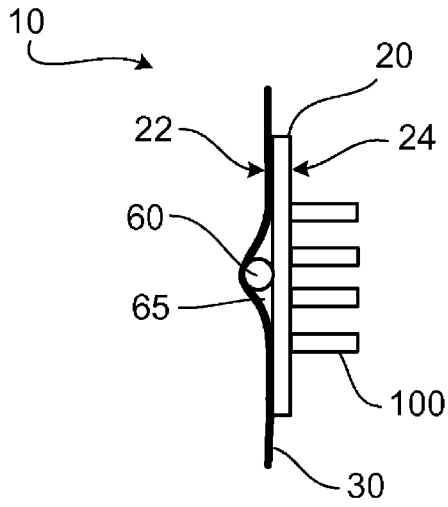
FIG. 1A is a side view of a touch fastener.
Figure 1B:
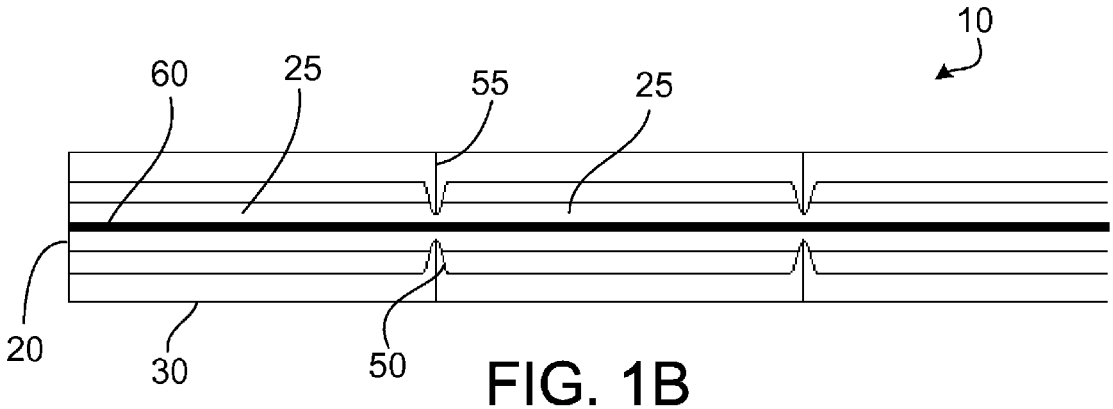
FIG. 1B is a top view of a touch fastener.

Referring to FIGS. 1A-1B, a touch fastener 10 includes an elongated base 20 having multiple segments 25 connected by articulable joints 40, each segment 25 having upper and lower surfaces, 22 and 24 respectively. The articulable joints 40 facilitate bend points which allow the full length part to approximate a curve of the touch fastener 10. A plurality of touch fastener elements 100, as shown in FIG. 1, extend from the lower surface 24 of the base 20. A flexible barrier 30 extends across at least one articulable joint 40 between adjacent base segments 25. In one implementation, the fastener 10 includes a magnetically attractable material 60, such as steel wire, disposed along a center region of the upper surface of the base 20 and extends across at least one articulable joint 40. In some cases, the magnetically attractable material 60 is secured to the upper surface 22 of the base 20 by resin 65 or a discrete bead of hot melt adhesive or it may be attached mechanically by sandwiching it between the hook base 20 and a backing material or film 30 which are attached along the edges (e.g. by resin 29 or hot melt adhesive). In one example, a magnetically attractable shim 60 is welded at the ends only. In other instances, a wire 60 is glued in the middle of the part 10 with a single dot of glue and the wire 60 is only held in place along the remaining length of the product 10 by the tent that is formed as the barrier film is laid over it and glued onto the hook. Significant issues may arise with continuous attachment of metal to plastic. They expand and contract at different rates due to the humidity and temperature of resin curing. If the wire 60 is glued in and not free to slide along the surface of expanding or contracting plastic, curved parts may result.

In some instances, the touch fastener product can be laminated to a mesh or scrim material. The scrim material can provide improved dimensional stability. Moreover, the scrim material can be magnetic (or attracted to magnets) (e.g., a ferrous-impregnated non-woven material), thus providing a magnetically attractable material as discussed above. Suitable examples of laminates are described in U.S. Pat. No. 5,518,795 to Kennedy et al. entitled LAMINATED HOOK FASTENER, the entire disclosure of which is incorporated herein by reference.

In the examples shown in FIGS. 2A-2G, the touch fastener 10 includes a magnetically attractable material 60 having an iron composite strand construction. In one configuration, a magnetically attractable material 60A includes a multi-filament thread 62 encapsulated with a dry mixture 64 of a water based polymer emulsion and iron powder (e.g. having particles ranging in size from 50-200 μm). The outer surface 61 of the magnetically attractable material 60 may be coated with a non-self adhering substance 66.

In another configuration, a magnetically attractable material 60B includes an extruded longitudinal strand of plastic resin (e.g. Polypropylene or Polyetheylene) combined with iron powder (particles can range in size from 50-200 μm). Iron powder is compounded with a plastic resin such as polypropylene or polyethylene. The compounded resin is then converted into pellet form, which is fed to an extrusion process, where the pellets are melted and formed into any number of shapes. FIGS. 2H-2M provide cross sectional views of extruded shapes of the extruded magnetically attractable material 60B. These shapes include circular, elliptical, rectangular, square, triangular, Y-shaped, X-shaped, and I-shaped.

Figure 2A:
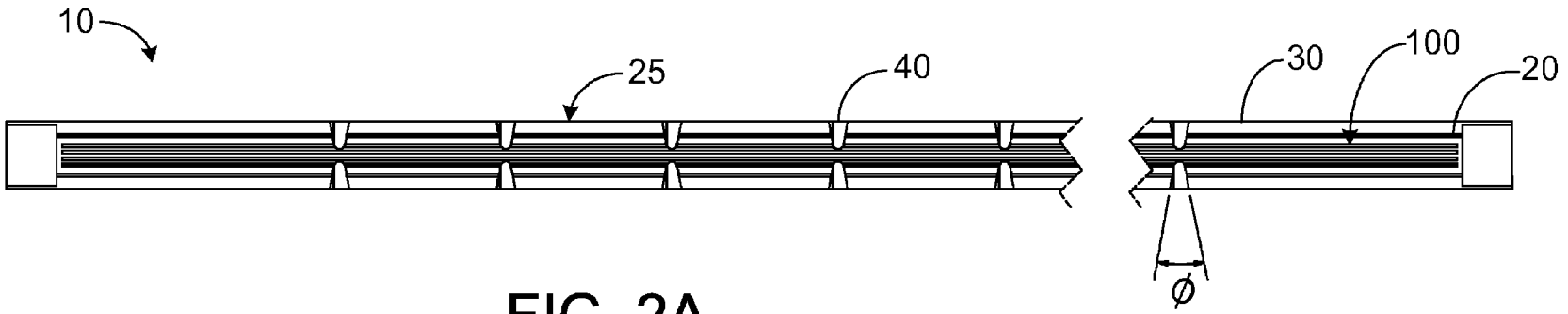
FIG. 2A is a top view of a touch fastener.
Figure 2B:
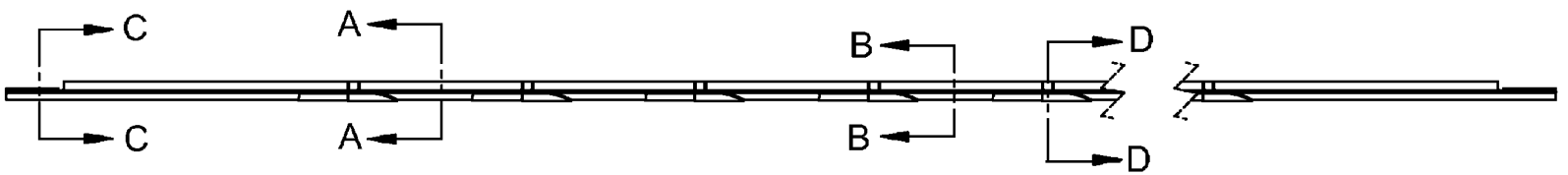
FIG. 2B is a side view of the touch fastener shown in FIG. 2A.
Figure 2C:
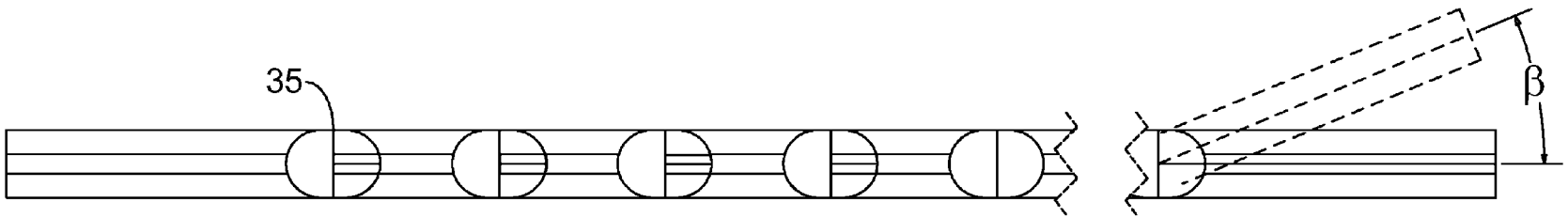
FIG. 2C is a bottom view of the touch fastener shown in FIG. 2A.
Figure 2D:
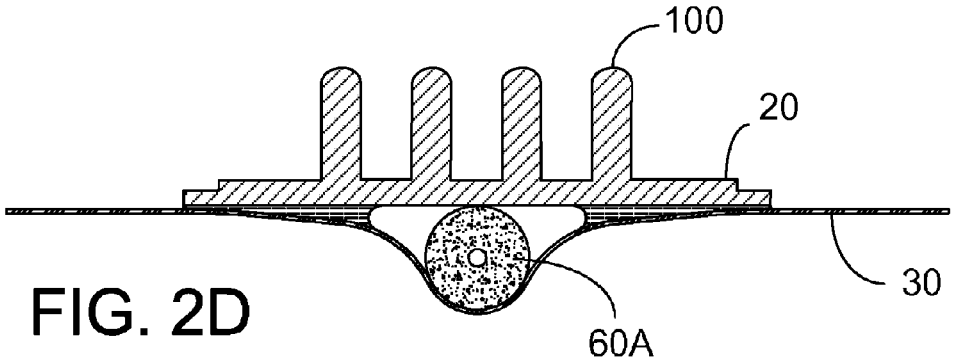
FIGS. 2D-2G are section views of the touch fastener shown in FIG. 2A at various locations along the touch fastener.
Figure 2E:
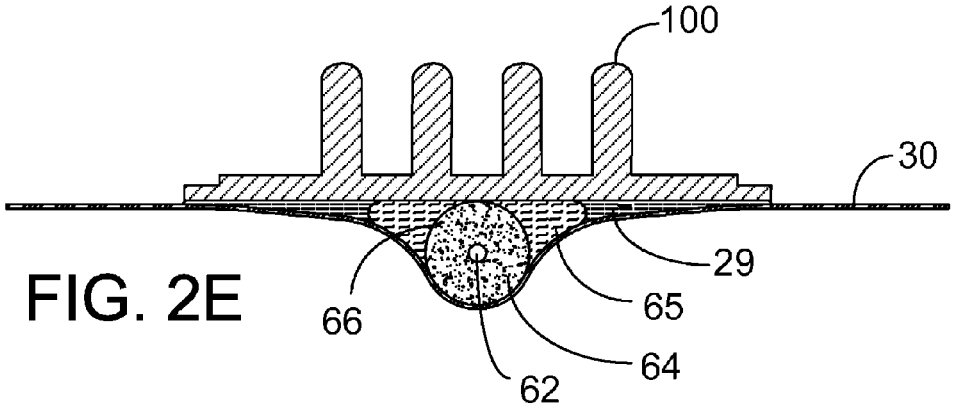
Figure 2F:
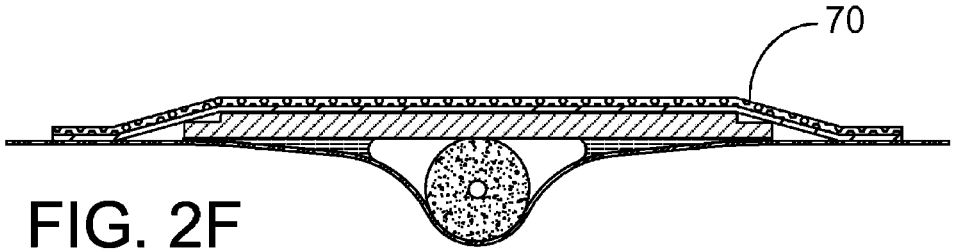
Figure 2G:
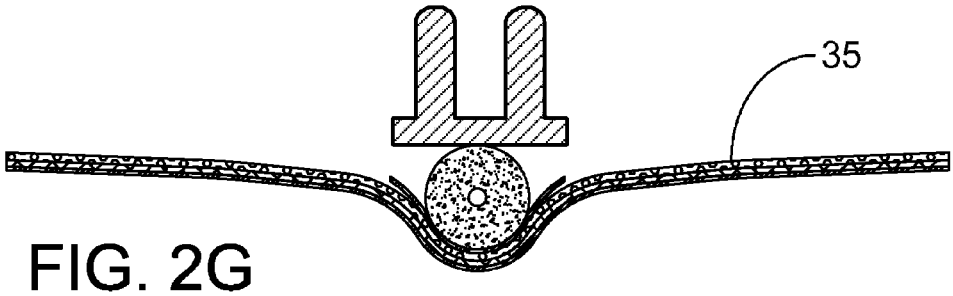
Figure 2H:
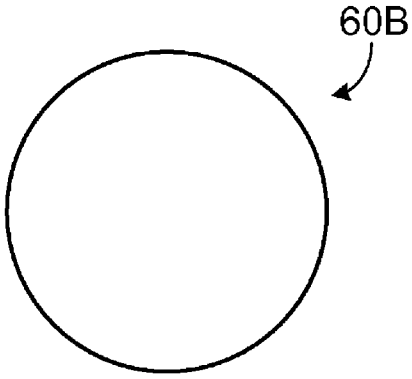
FIG. 2H is a section view of a magnetically attractable material having a circular shape.
Figure 2I:
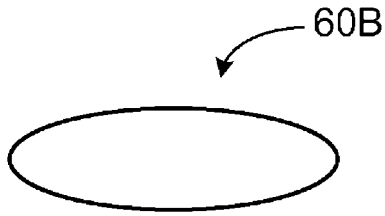
FIG. 2I is a section view of a magnetically attractable material having an elliptical shape.
Figure 2J:
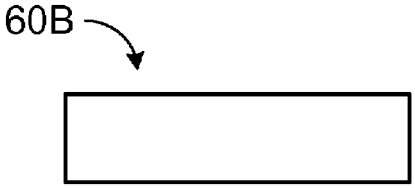
FIG. 2J is a section view of a magnetically attractable material having a rectangular shape.
Figure 2K:
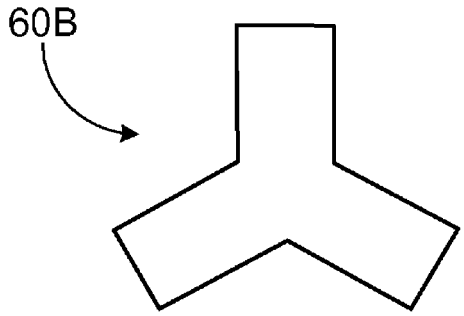
FIG. 2K is a section view of a magnetically attractable material having a Y-shape.
Figure 2L:
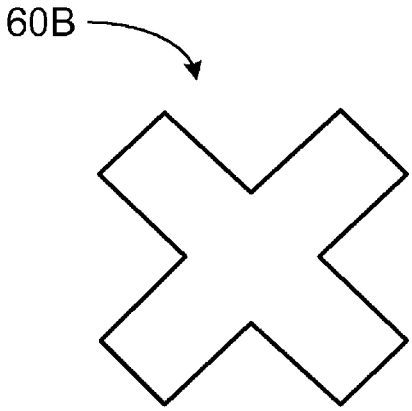
FIG. 2L is a section view of a magnetically attractable material having an X-shape.
Figure 2M:
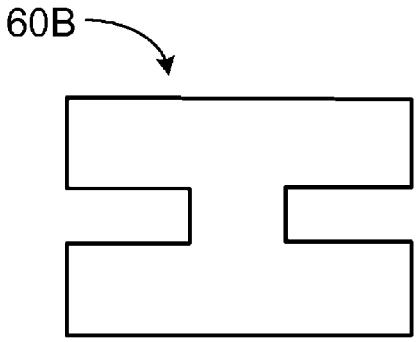
FIG. 2M is a section view of a magnetically attractable material having an I-shape.

Referring to FIGS. 2A, 2B, and 2F, in some implementations, the touch fastener includes an end barrier 70 (e.g. non-woven material) disposed at each longitudinal end of the base 20. The end barrier 70 aids prevention of resin entering onto the hooks 100 during the molding process.

In some implementations, a touch fastener 10 includes an elongated base 20 having upper and lower surfaces 22 and 24 and a plurality of touch fastener elements 100 extending from the lower surface 24 of the base 20. The base 20 defines a series of spaced apart pairs of opposite notches 50 in its longitudinal edges and forming respective articulable base joints 40. Adjacent pairs of notches 40 define respective base segments 25 between them. The notches 50 are each sized with respect to an overall width of the base 20 such that, when one of the articulable joints 40 is flexed to close one of its corresponding notches 50, the other of its corresponding notches 50 opens only to a longitudinal gap dimension less than about 0.5 millimeters. A gap of about 0.5 millimeter will generally not allow significant foam intrusion during a molding process such that it hinders hook performance. Nevertheless, larger gaps that do allow foam intrusion may still be employed because the amount of hook covered with foam would be small compared to the discontinued hook conventionally seen in foam pads that have short hook parts spaced apart to approximate a curve.

Figure 3:
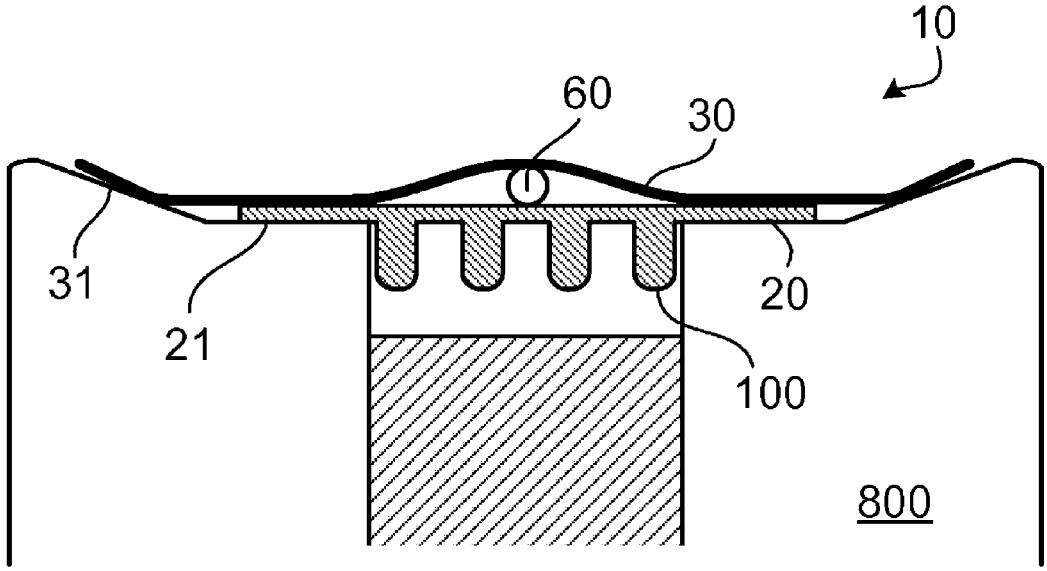
FIG. 3 is a sectional view of a touch fastener.
Figure 4:
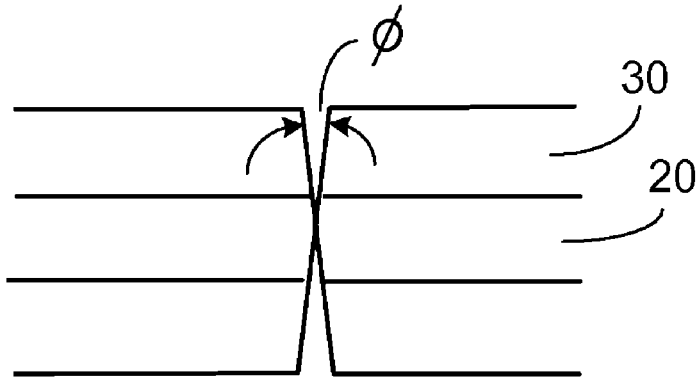
FIG. 4 is a top view of an articulated joint of a touch fastener.
Figure 5:
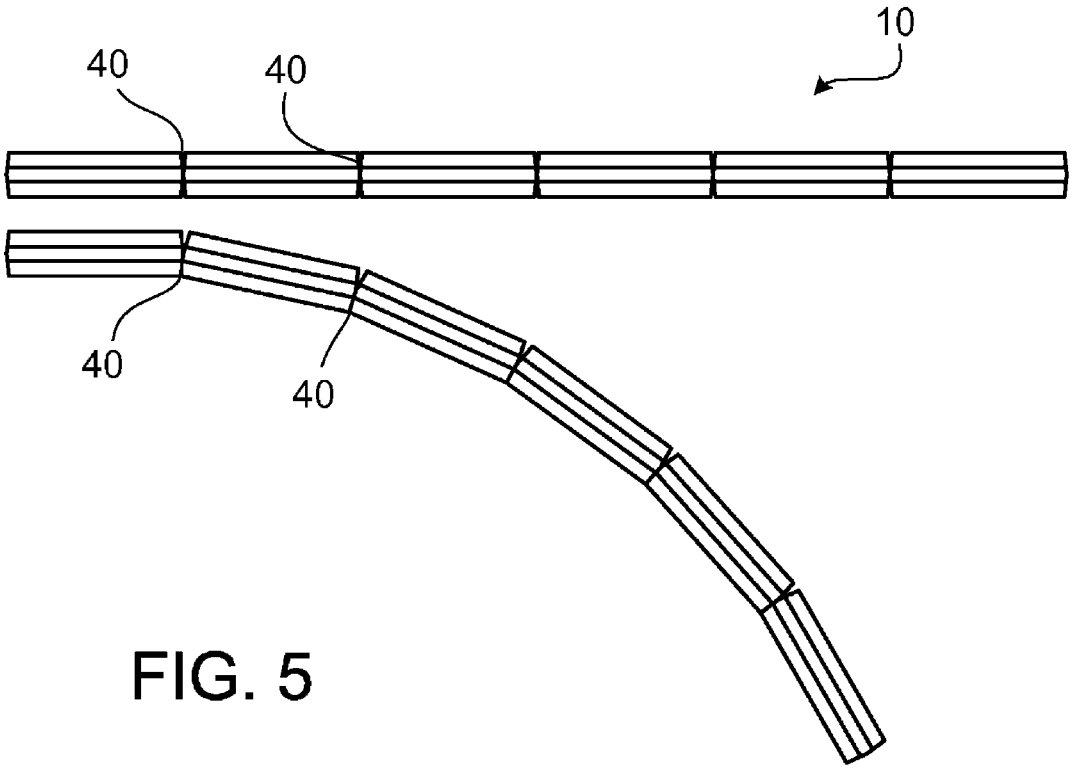
FIG. 5 is a top view of a touch fastener being bent in a curved path.
Figure 6:
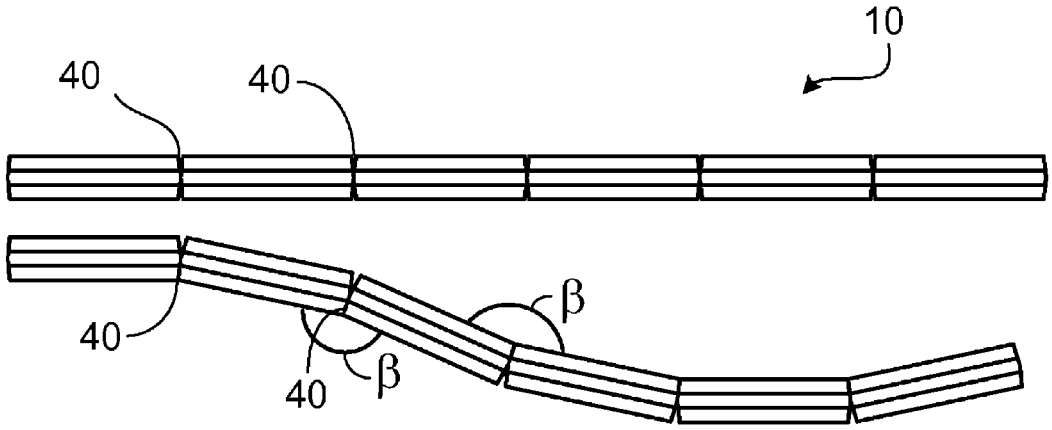
FIG. 6 is a top view of a touch fastener being bent in multiple curved paths.
Figure 7:
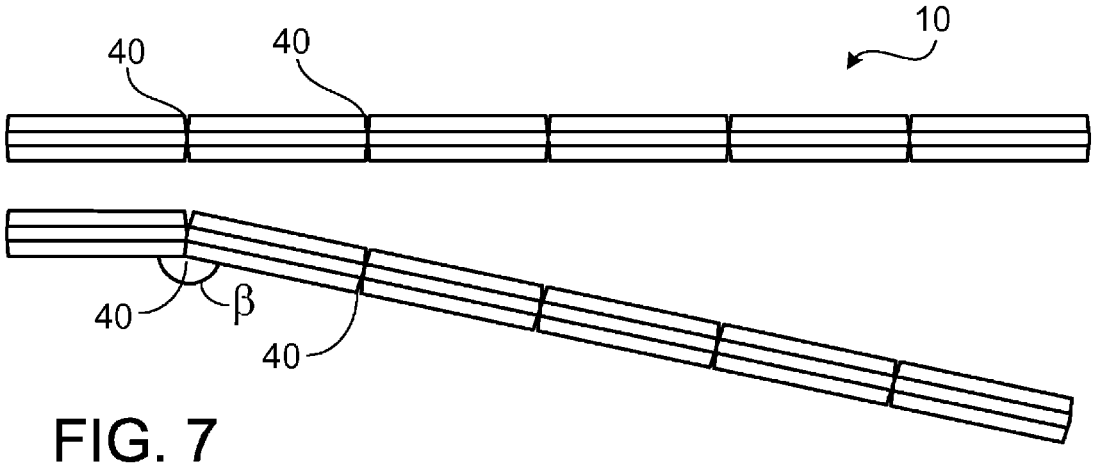
FIG. 7 is a top view of a touch fastener being bent at one articulated joint.
Figure 8:
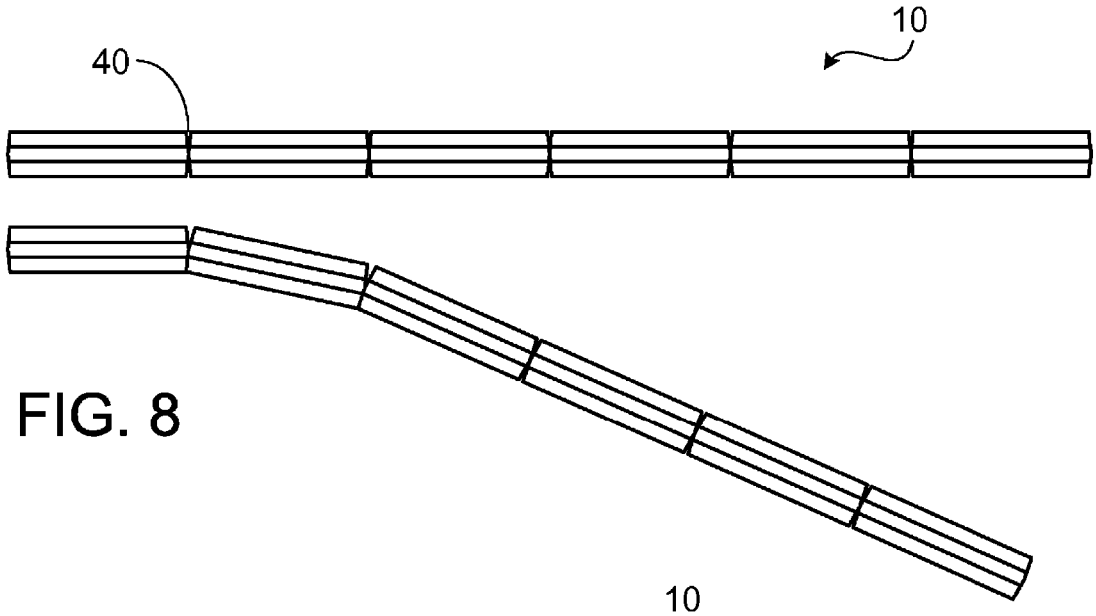
FIG. 8 is a top view of a touch fastener being bent at two articulated joints.

The barrier 30 is generally wider than the base 20, such that the barrier 30 generally extends beyond the longitudinal edges of the base 20 and, in one implementation, extends beyond the longitudinal edges of base 20 at joints 40, as shown in FIG. 3. In one example, the barrier 30 comprises an elastomeric material and is more flexible than the base 20. The barrier 30 may also be a film, such as a polyamide film having a nominal thickness of about 0.002 inch. Although a polyamide film is described in one implementation, other films could also be used, including polyurethane or polyester or other resin films. Furthermore, the barrier 30 may be bonded to the base 20 with adhesive or directly laminated to the resin of the hook base 20.

In one example, the base 20 has a width of about 8 mm and is constructed from a resin, such as polyester, polypropylene, or nylon, and has a nominal thickness of about 0.010 inch. The array of fastener elements 100 extends over a longitudinal central region of a lower face 24 of the base 20 that is about 4 mm wide. In the same example, the film barrier 30 is about 12 mm wide, extending laterally and longitudinally beyond the base 20. The selvedge that seals on the tool is comprised of the very flexible edges of the barrier 30 and at the rigid selvedge of the base 20. The fastener elements 100 are hooks positioned in alternating rows of hooks facing in opposing directions. As shown in FIG. 3, the rigid selvedge of the base 20 and the barrier 30 provide primary 21 and secondary 31 seals as the fastener part 10 is placed on a tool 800 for a molding process.

The film 30 may be a polyamide film secured by a moisture cure polyurethane adhesive. The film 30 has a nominal thickness of less than about 0.020 inch. In one example, the film has a nominal thickness of about 0.002 inch. In other examples the film has a nominal thickness of less than about 0.010 inch. The film has a flexural rigidity of about 1800 mg-cm and a tensile stiffness of between about 1000 and about 3000 mg-cm.

Referring to FIGS. 4-15, the base 20 defines a pair of first and second notches 50 in opposite longitudinal edges of the base 20 at an articulable joint 40. The notches 40 extend completely through the base 20 and in one example define a longitudinal gap dimension of less than about 0.25 inches. Edges of the base 20 in first and second notches 50 may be bent in opposing directions to facilitate overlap during curvature of the base 20. FIGS. 4-15 illustrate multiple implementations of approximate curvatures attainable with touch fastener 10.

Figure 9:
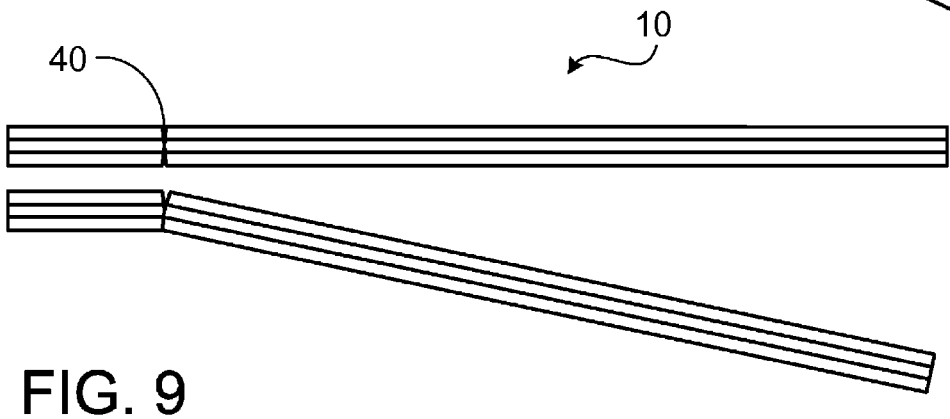
FIG. 9 is a top view of a touch fastener with one articulated joint.

In the examples illustrated in FIGS. 5-9, the articulated joint provides a bend angle β of between about 20° and about 25°, preferably 22.5°. For manufacturability, the notches 50 may be formed at standard intervals, as shown in FIGS. 5-8, even though different portions of the fastener 10 are manipulated into curved profiles. In other examples, as shown in FIG. 9, the notches 50 may be formed only in regions where curvature of the fastener 10 is required.

Figure 10:
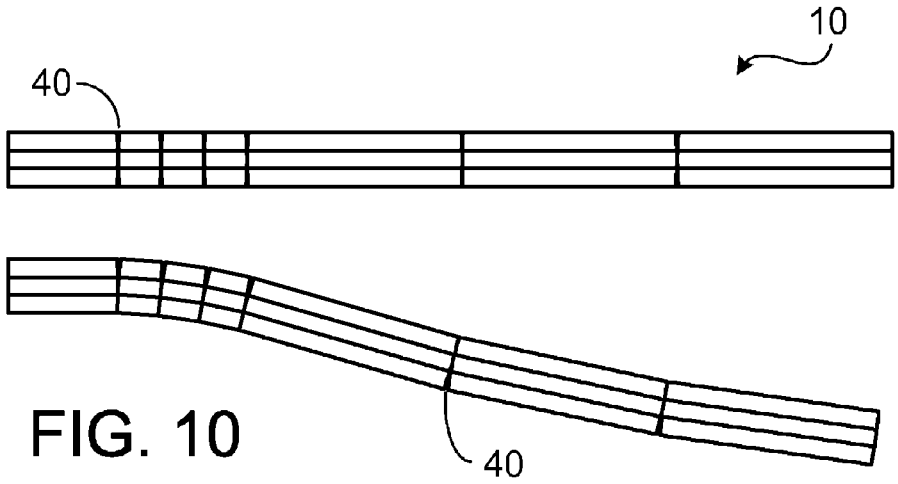
FIG. 10 is a top view of a touch fastener with several articulated joints spaced at different intervals.

Referring to FIG. 10, the articulable joints 40 are spaced closer together along some regions of the base 20 than along other regions of the base 20. In one example, the articulable joints 40 have a longitudinal joint spacing of between about 5 and 50 millimeters. However, there could be some cases where the notches 50 are required to have a longitudinal joint spacing of about 200 mm. In another example, the touch fastener 10 includes articulable joints 40 have a longitudinal joint spacing of about 200 to 400 millimeters with the notches 50 that each define an included notch angle ϕ of about 12° between opposing surfaces of the base 20.

Figure 11:
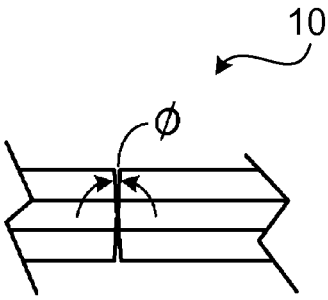
FIGS. 11-13 are top views of articulated joints of touch fasteners having different notch angles.
Figure 12:
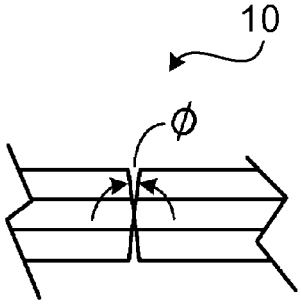
Figure 13:
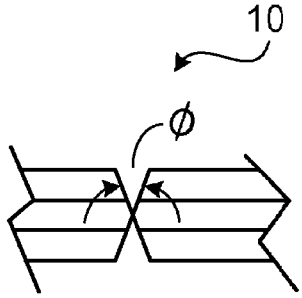
Figure 14:
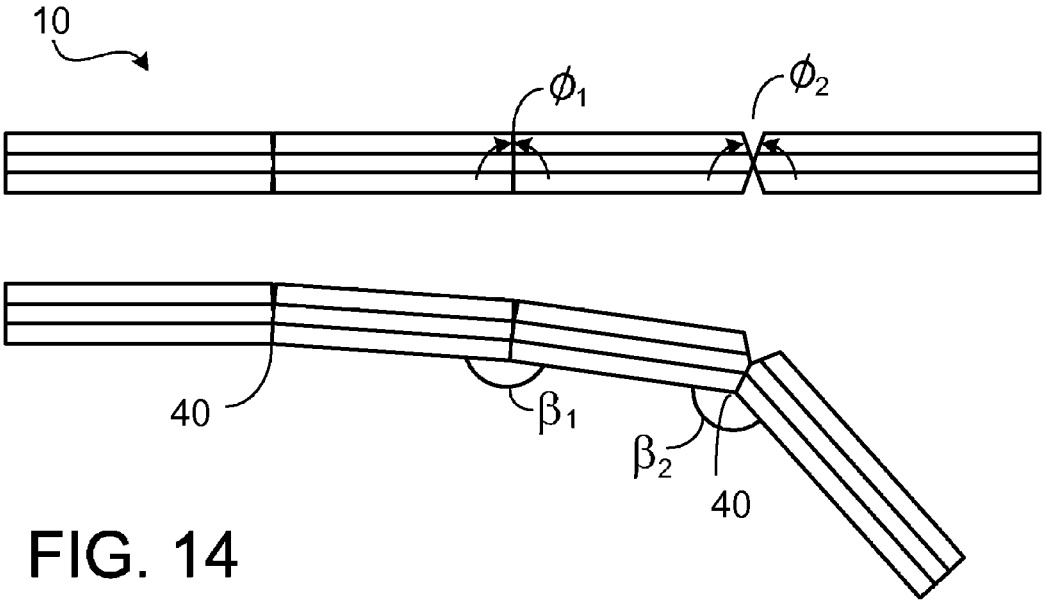
FIG. 14 is a top view of a touch fastener with several articulated joints having one or more different notch angles.
Figure 15:
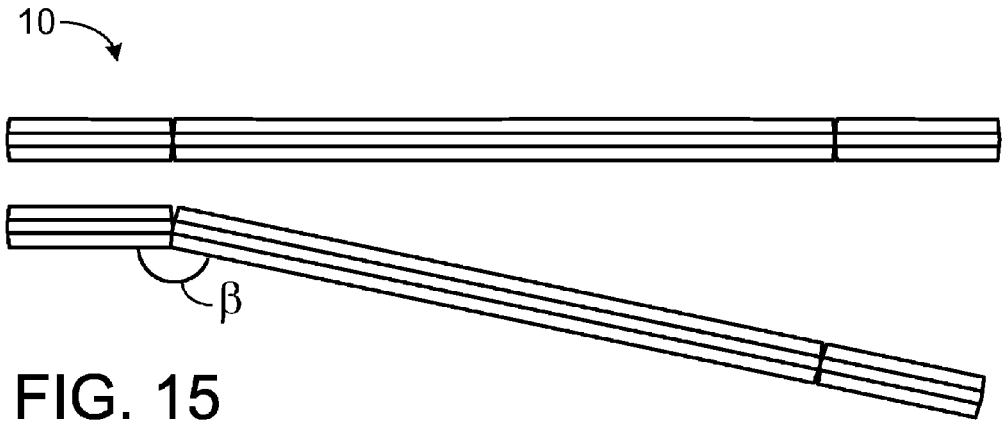
FIG. 15 is a top view of a touch fastener with two articulated joints.

In the examples illustrated in FIGS. 11-13, the notches 50 define an included notch angle ϕ between opposing surfaces of the base 20 of between about 2° and about 90°, preferably 20°. FIG. 14 illustrates an example of a touch fastener 10 having articulated joints 40 with defined notches 50 having different included notch angles $\phi_1$, $\phi_2$, such that the touch fastener attains greater bend angles $\beta_2$ at articulated joints 40 with respective larger notch angles $\phi_2$. FIG. 15 illustrates an example of a touch fastener 10 having articulated joints 40 located only locations where bending is necessary (e.g. near the ends) and having defined notches 50 having the same included notch angles ϕ.

Figure 16:
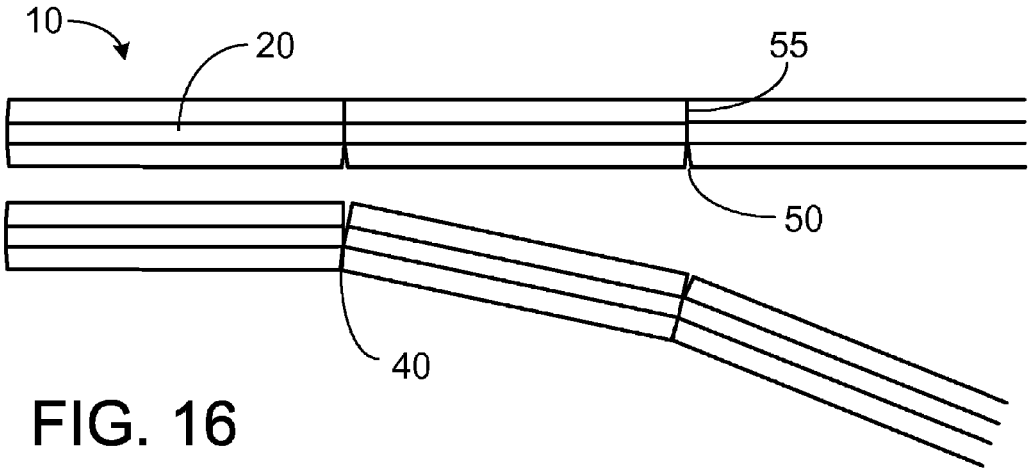
FIG. 16 is a top view of a touch fastener with one articulated joint having two different notch angles and another articulated joint having two equal notch angles.
Figure 17:
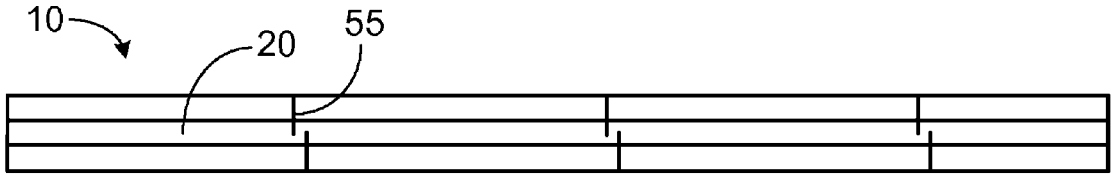
FIG. 17 is a top view of a touch fastener having a base defining slits.
Figure 18:
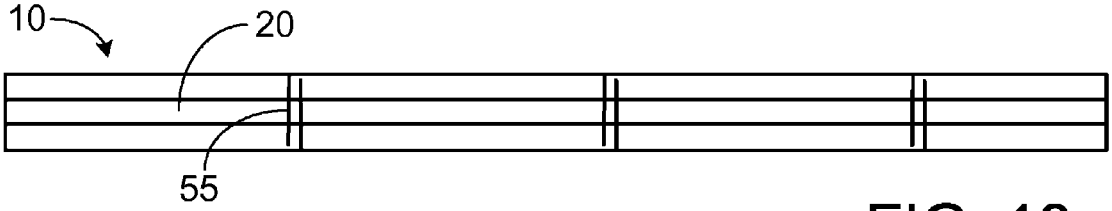
FIG. 18 is a top view of a touch fastener having a base defining slits extending across a majority of a lateral width of the base.
Figure 19:
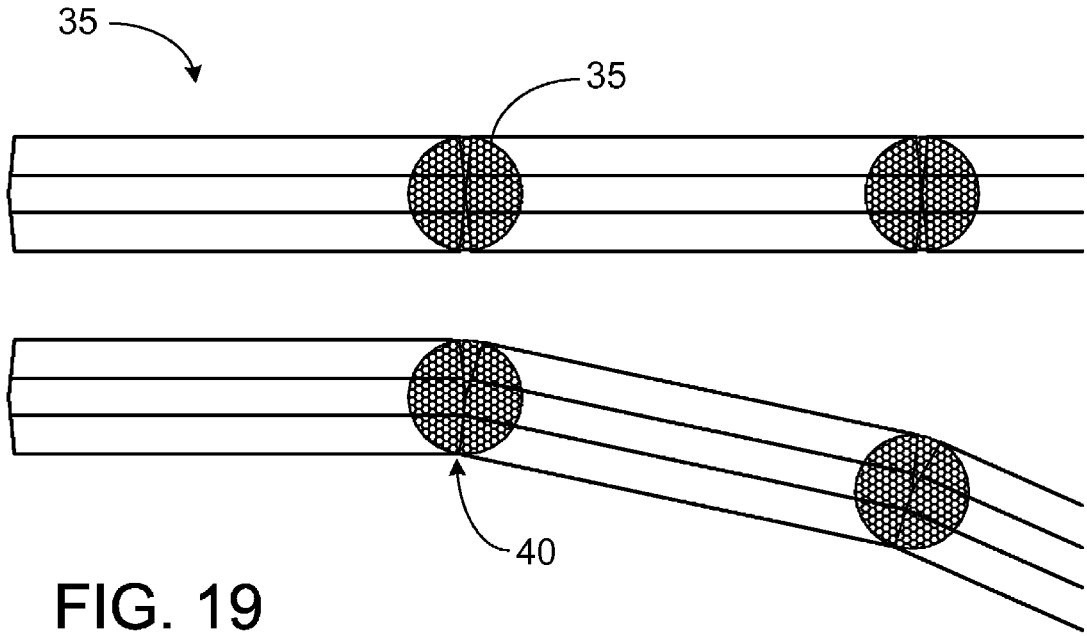
FIG. 19 is a bottom view of a touch fastener including multiple discrete barrier segments extending across respective articulated joints.

Referring to FIGS. 16-18, the base 20 defines a slit 55 which extends through the base 20 from a longitudinal edge thereof at the articulable joint 40. In one example, as shown in FIG. 18, the slit 55 extends across a majority of a lateral width of the base 20. FIG. 16 illustrates another example where the base 20 defines a notch 50 which extends from a longitudinal edge of the base 20 opposite the slit 55. Referring again to FIG. 1B, the flexible barrier 30 defines a slit 55 in through a longitudinal edge of the barrier 30 and aligned with one of the notches 50 at the articulable joint 40. In one example, the barrier 30 defines two slits 55 through opposite longitudinal edges of the barrier 30 and aligned with first and second notches 50 of the base 20.

Figure 20:
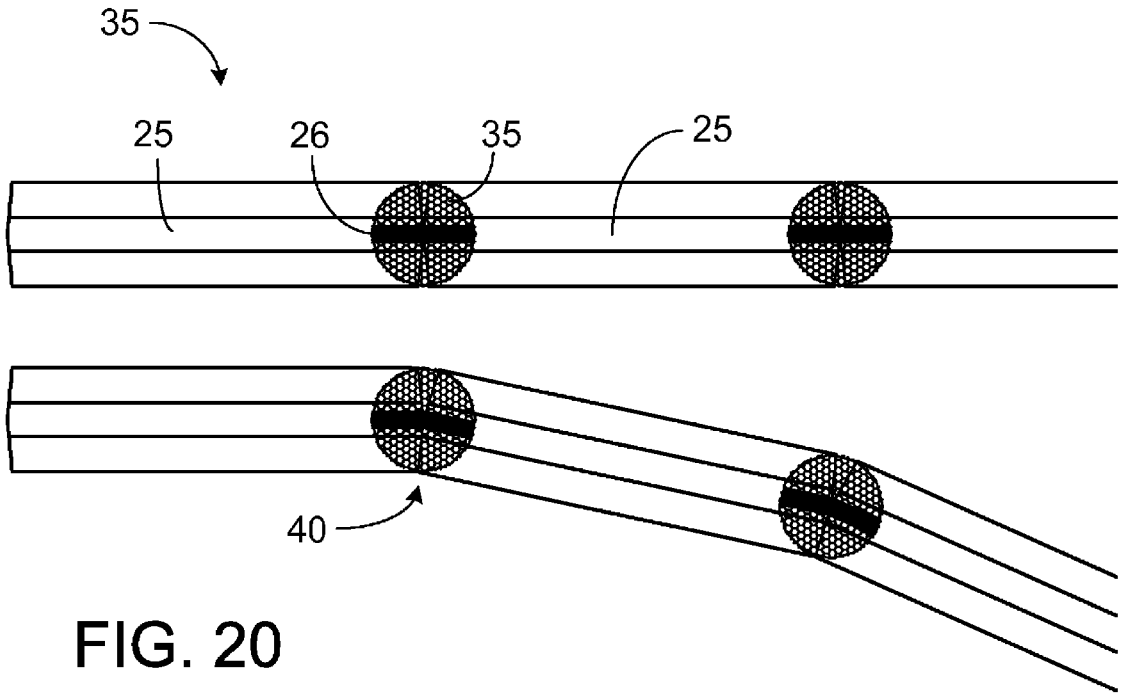
FIG. 20 is a bottom view of a touch fastener including discrete barrier segments secured to longitudinal center portions of adjoining base segments.
Figure 21:
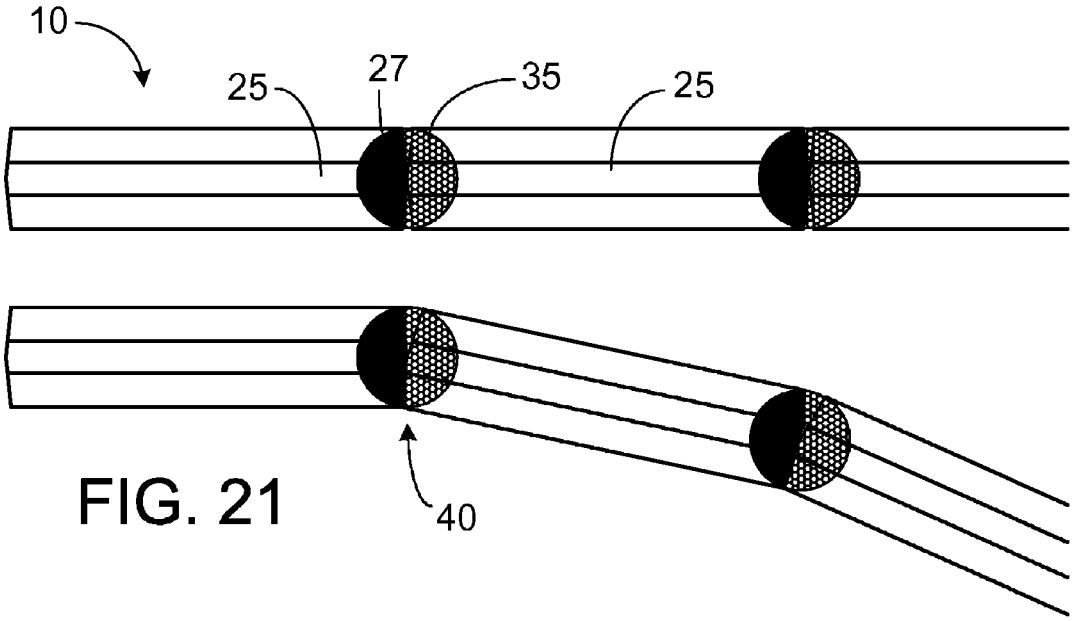
FIG. 21 is a bottom view of a touch fastener including discrete barrier segments, each secured to a portion of one adjoining base segment.
Figure 22:
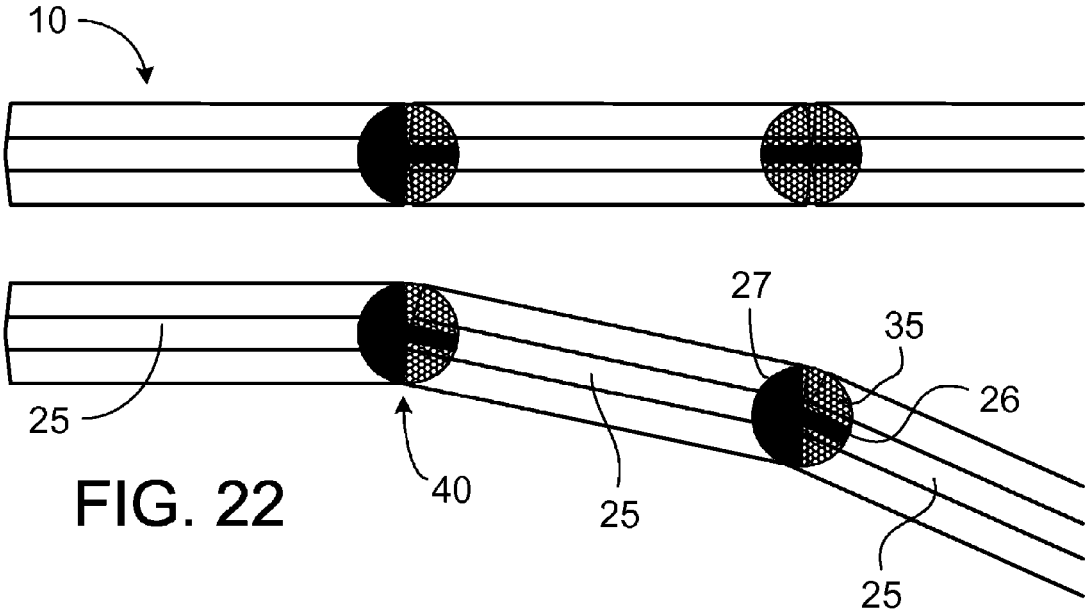
FIG. 22 is a bottom view of a touch fastener including discrete barrier segments, each secured to at least a portion of one adjoining base segment and longitudinal center portions of adjoining base segments.
Figure 23:
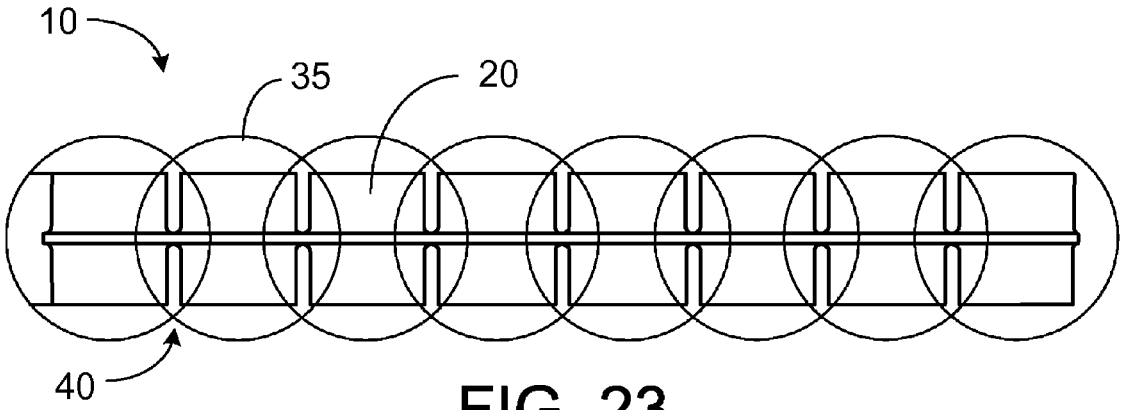
FIG. 23 is a schematic view of a touch fastener having a die cut base and barrier segments extending over at least one articulated joint.
Figure 24:
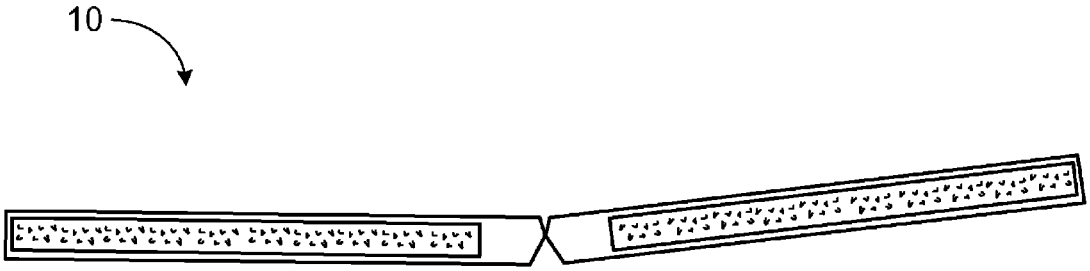
FIGS. 24-27 are top views of touch fasteners having barrier segments secured to a lower surface of a base, acting as a seal along the length of the base and having various notch configurations.
Figure 25:
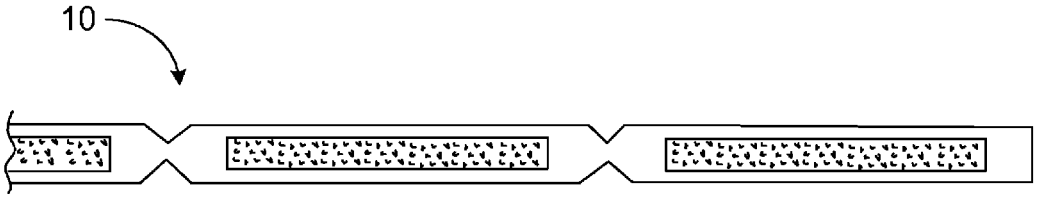

Referring to FIGS. 2C, 2G, and 19-23, the touch fastener 10 may include multiple discrete barrier segments 35 (e.g. non-woven material), each barrier segment 35 extending across at least one respective articulable joint 40. In one example, the barrier segment 35 may be secured to longitudinal center portions 26 of two adjoining base segments 25, as shown in FIG. 20. In another example, the barrier segment 35 is secured along a portion 27 of only one of the two adjacent base segments 25 defining its respective articulable joint 40, as shown in FIG. 21. The previous two examples may be combined, as shown in FIG. 22, such that the barrier segment 35 is secured to only one of the two adjacent base segments 25 defining its respective articulable joint 40 as well as to longitudinal center portions of the two adjoining base segments 25. The barrier segment 35 may be secured to the upper surface 22 of the base 20 and/or the lower surface 24 of the base 20. In FIG. 23, the joints 40 may be formed by rotary die cutting the base 20.

Figure 26:
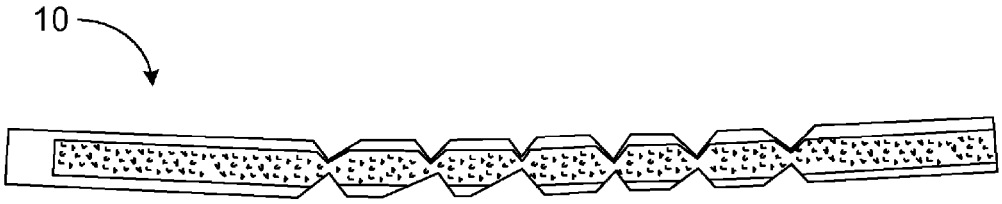
Figure 27:
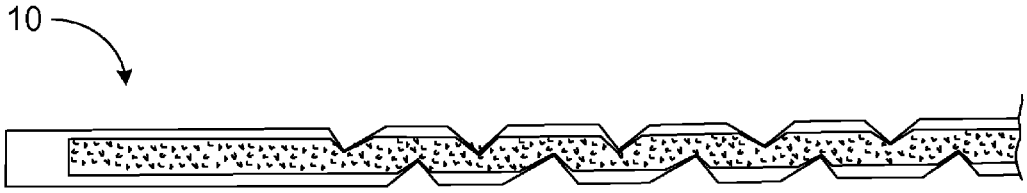

Referring to FIGS. 24-27, the touch fastener 10 may include discrete barrier segments 35 secured to the lower surface of the base 20, each barrier segment 35 extending across at least one respective articulable joint 40. In another instance, the barrier segment 35 does not extend across any joints 40, but rather acts as a seal over the length of the segment 35. These barrier segments 35 may comprise fabric patches or foam to stop foam intrusion during a molding process, such as molding a seat bun. FIGS. 24-27 illustrate multiple implementations of notch 50 configurations defined along the base 20 to achieve numerous curved configurations of the touch fastener 10. FIG. 26 illustrates notches 50 on opposite longitudinal edges of the base 20 at the articulable joint 40 with different notch angles $\phi$ defined between opposing base 20 surfaces. FIG. 27 illustrates notches 50 defined at different locations on opposite longitudinal edges of the base 20. In some implementations, the joints 40 are formed in the base 20, the base 20 is bent at one or more joints 40 to attain a desired curvature or shape, and then barrier segments 35 are secured over the joints 40 (e.g. bonding the barrier segments 35 to both adjacent base segments 25 defining each respective articulable joint 40) to hold the base 20 at the desired curvature or shape. The resulting touch fastener 10 may then be placed on a molding tool 800 for subsequent use in a seat bun molding process.

Figure 28:
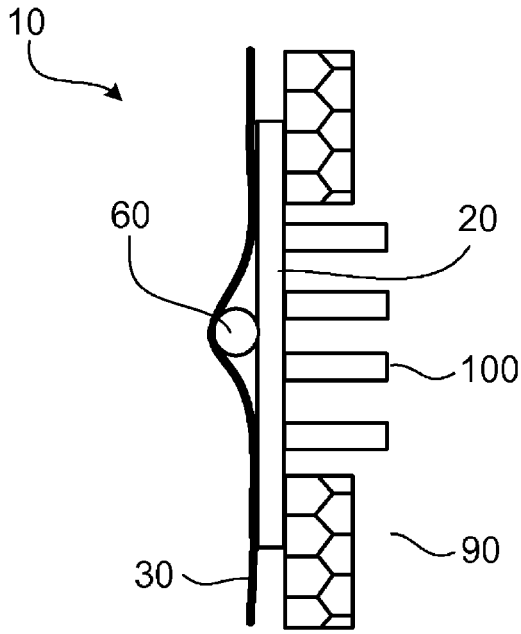
FIG. 28 is a side view of a touch fastener having a flexible compressible gasket secured to a lower surface of a base.
Figure 29:
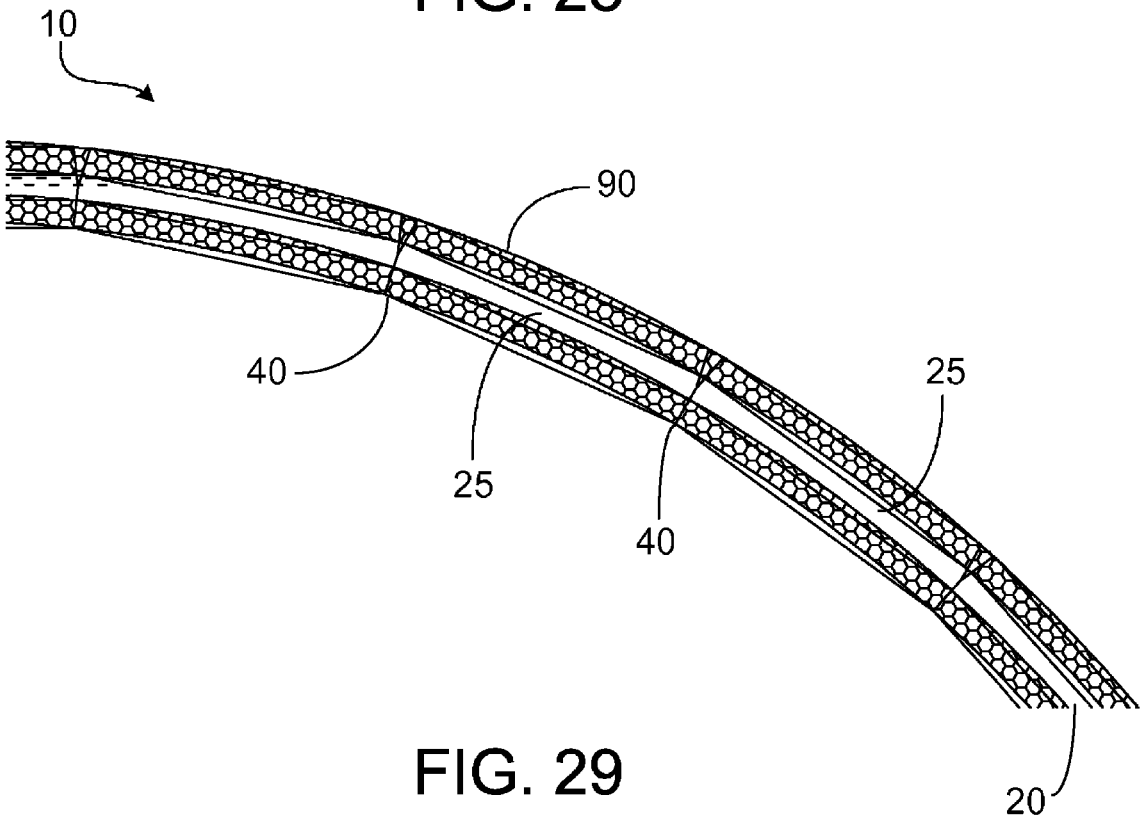
FIG. 29 is a bottom view of a touch fastener having a flexible compressible gasket secured to a lower surface of a base.

Referring to FIGS. 28-29, the touch fastener 10 may include a flexible compressible gasket 90 secured to the lower surface of the base 20. The gasket 90 extends across at least one articulable joint 40 to impede foam intrusion during a molding process. In another implementation, the barrier 30 comprises a compressible gasket.

Figure 30:
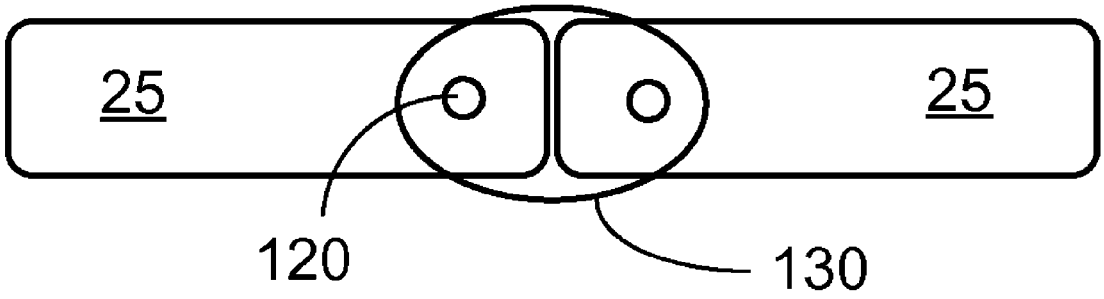
FIG. 30 is a bottom view of a touch fastener having rotatable pivots at articulable joints.
Figure 31:
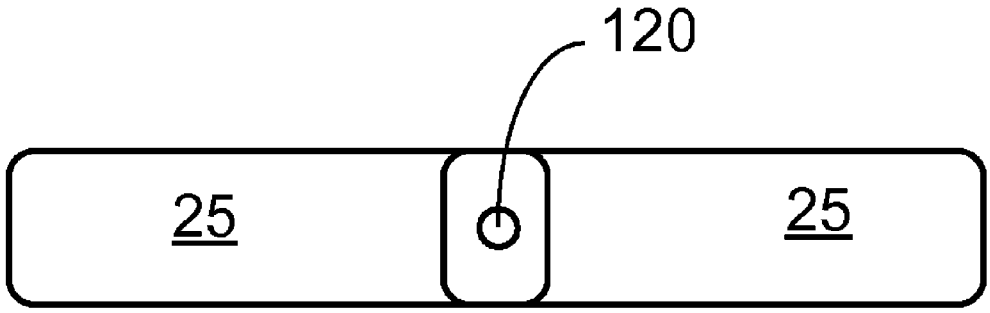
FIG. 31 is a bottom view of a touch fastener having base segments joined by a rotatable pivot at an articulable joint.

Referring to FIGS. 30-31, adjacent base segments 25 of the touch fastener 10 are joined at rotatable pivots 120 at an articulable joints 40. In FIG. 30, adjacent base segments 25 are joined at articulable joints 40 by a link 130 at rotatable pivots 125. In one example, the link 130 attaches to base segments 25 in a manner that minimizes or eliminates discontinuous hook. Another way to eliminate discontinuous hook at the joint 40 is shown in FIG. 31, which depicts adjacent base segments 25 joined at the articulable joint 40 by a rotatable pivot 120.

As described earlier, the flexible barrier 30 may be extended across at least one articulable joint 40 between adjacent base segments 25.

Figure 32A:
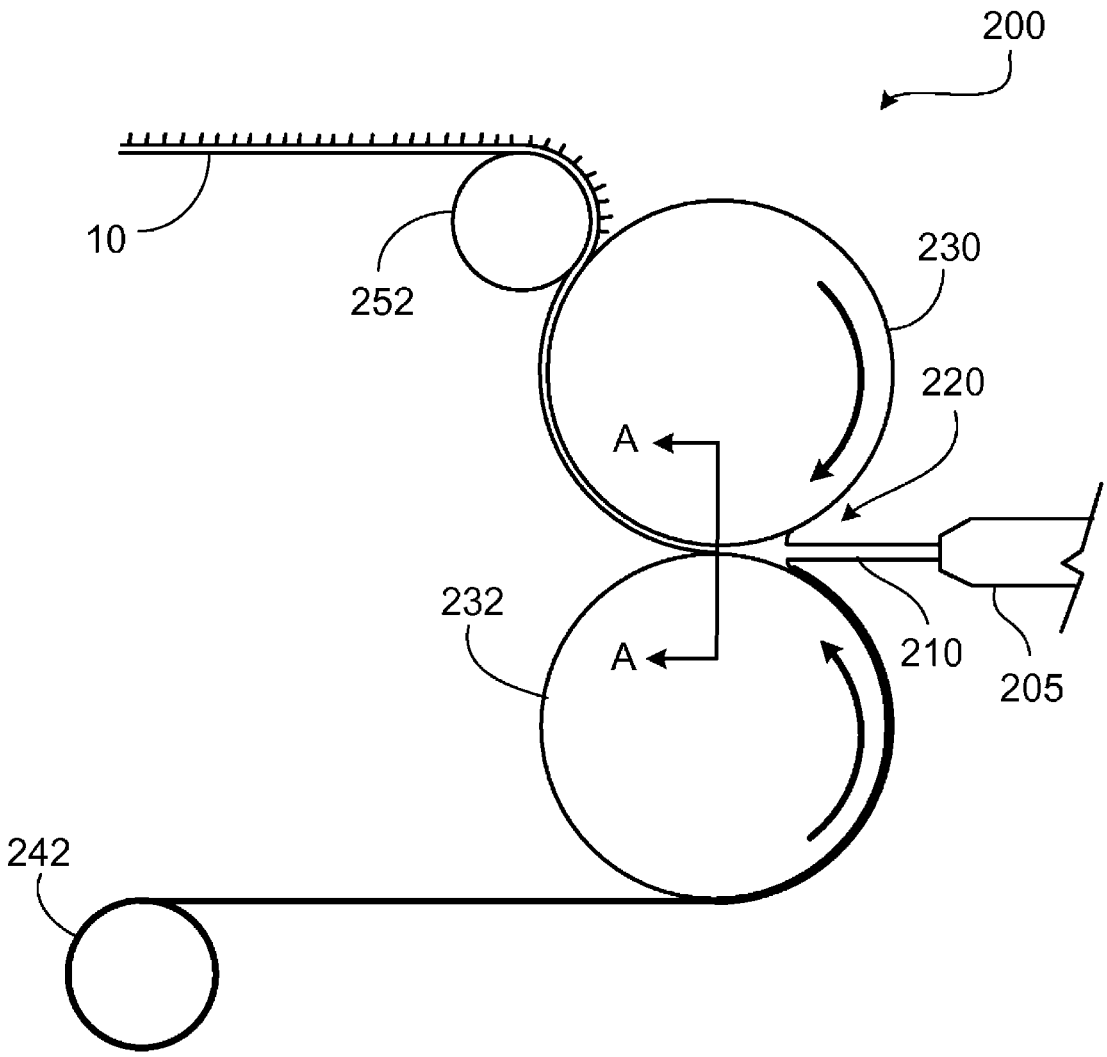
FIG. 32A is a schematic view of an apparatus and method of manufacturing a touch fastener.
Figure 32B:
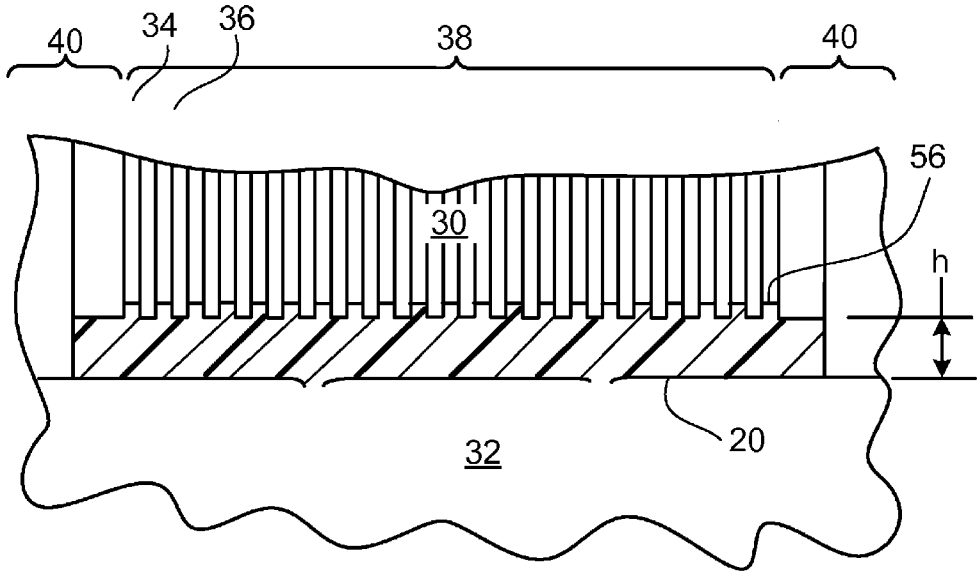
FIG. 32B is a section view of a mold roll having tool and spacer rings.
Figure 32C:
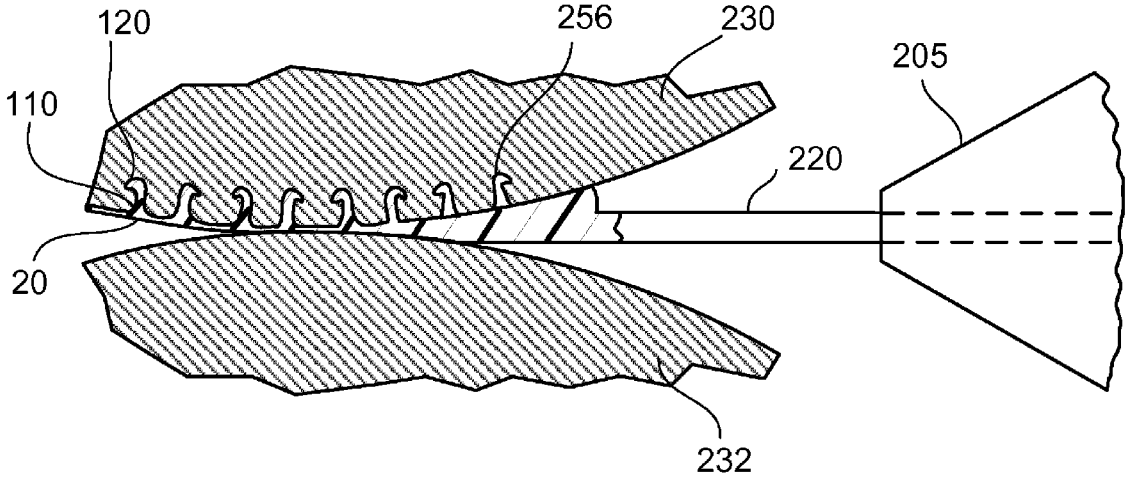
FIG. 32C is a partial section view of a mold roll having cavities that receive molten resin.

A method of making a touch fastener 10 with an example apparatus 200, as illustrated in FIGS. 32A-32C, includes continuously introducing a flexible substrate 242 to a gap 220 formed along a peripheral surface of a rotating mold roll 230. Another step includes introducing molten resin 210 to the gap 220 between the substrate 242 and the peripheral surface of the mold roll 230, such that the resin 210 at least partially fills an array of cavities 256 defined in the rotating mold roll 230 to form resin stems 110 while a base 20 of resin interconnecting the stems 110 is laminated to the substrate on the peripheral surface of the mold roll 230. Additional steps include forming engageable heads 120 on the stems and forming longitudinally spaced apart discontinuities 50, 55 in the base 20 to provide articulable joints 40 between adjacent base segments 25, across which the substrate 242 extends. In one implementation, the discontinuities 50, 55 are formed by introducing resin 210 to the gap 220 in longitudinally spaced apart quantities defining gaps between them. Additionally, the discontinuities 50, 55 may be formed after the resin base 20 is stripped from the mold roll 230. The heads 120 may be formed by molding the heads 120 with the stems 110 in the cavities 256. Methods of forming molded touch fasteners having stems or fastener elements extending integrally therefrom are well known in the art. For example, a continuous extrusion/roll-forming method for molding fastener elements on an integral, sheet-form base is described in detail in U.S. Pat. No. 4,794,028 and in U.S. Pat. No. 4,775,310, the entire disclosures of which are incorporated herein by reference. During the step of forming articulable joints 40, a pair of first and second notches 50 may be formed in opposite longitudinal edges of the base 20 at the articulable joint 40. The notches 50 may be formed by passing the base 20 through a rotary or stationary die cutter. The notches 52 may extend completely through the base 20.

In example apparatus 200, the gap 220 is a nip defined between the mold roll 230 and a counter-rotating pressure roll 232. Referring to FIG. 32B, the mold roll 230 is assembled from multiple tool rings 234 and spacer rings 236 in a tooling region 238 and spacer rings in end regions 240 on either side of the tooling region. In this case, the spacer rings 236 in the end regions 240 are also used as vertical spacers that provide a mechanical limit helping control the height of the nip 220 and the amount of pressure applied to the resin and thus to a substrate, such as a barrier 30. Because the mold roll 320 and the pressure roll 232 are in close proximity if not in actual contact, the spacer rings in the end regions 240 comprise an engineering elastomer, at least on their outer surfaces, to limit damage to the rolls 230, 232 due to contact between the rolls.

Pressure applied in the nip causes the molten resin to enter mold cavities 256, defined by the tool rings 234, which are configured to mold the molten resin into desired shapes (e.g. hooks with loop-engageable heads). For purposes of illustration, the size of the mold cavities is exaggerated and the number of mold cavities and associated tool and spacer rings is reduced in all of the Figures showing mold cavities. All of the mold rolls are assembled of tool and spacer rings although individual rings are only shown in FIG. 32A.

The mold roll 230 is temperature controlled to solidify the molten resin as a base 20 and molded hooks 100 extending from the base. The hooks 100, resin base 20, and attached substrate 30 are stripped from the mold roll 230 by tension applied at a stripping roll 252. The resulting fastener product 10 may be gathered on a storage roll.

The method of making the touch fastener 10 may also include forming a slit 55 that extends through the base 20 from a longitudinal edge thereof at an articulable joint 40. The slits 55 may be formed by passing touch fastener 10 through a rotary or stationary die cutter. The slit 55 may extend across a majority of a lateral width of the base 20. Another step may include forming a notch 50 that extends from a longitudinal edge of the base 20 opposite the slit 55.

In one example, the method of making touch fastener 10 includes forming articulable joints 40 closer together along some regions of the base 20 than along other regions of the base 20. In one example, the articulable joints 40 are formed with a longitudinal joint spacing of between about 5 and 50 millimeters.

The method of making touch fastener 10 may also include securing a flexible barrier material 30 to the base 20, such that the barrier 30 extends across at least one articulable joint 40 between adjacent base segments 25. Additionally, a slit 55 may be formed in through a longitudinal edge of the flexible barrier 32 and aligned with one of the notches 50 at the articulable joint 40. For example, two slits may be formed through opposite longitudinal edges of the barrier 30 and aligned with first and second notches 50 of the base 20.

In another implementation, the method of making the touch fastener 10 may include securing multiple discrete barrier segments 35 to the base 20, where each barrier segment extends across at least one respective articulable joint 40. One step may include dispensing hot melt adhesive from a nozzle onto the base 20, followed by dispensing barrier segments 35 from a label dispenser onto and being secured to base 20. Each barrier segment 35 may be secured to longitudinal center portions of two adjoining base segments 25. In another example, each barrier segment 35 may be secured to only one of the two adjacent base segments 25 defining its respective articulable joint 40. Furthermore, the step may include securing each barrier segment 35 to longitudinal center portions of two adjoining base segments 25 as well as to only one of the two adjacent base segments 25 defining its respective articulable joint 40. Another step may include disposing a fabric patch over at least one articulable joint.

The method of making touch fastener 10 may also include the step of disposing a magnetically attractable material 60, such as a steel wire, along a center region of an upper surface of the base 20. The magnetically attractable material 60 is positioned so as to extend across at least one of the articulable joints 40. In addition, the magnetically attractable material 60 may be severed at the articulable joint 40 to allow greater movement about the joint 40. The magnetically attractable material 60 can be secured to the upper surface 22 of the base 20 by resin 65. In another example, the magnetically attractable material 60 is secured to the upper surface 22 of at least one base segment 25 in at least one location along the base segment, allowing the magnetically attractable material 60 to move at other locations.

Another step may include securing a flexible compressible gasket 90 to a lower surface of the base 20. The gasket 90 may be positioned so as to extend across at least one articulable joint 40 to impede foam intrusion during a molding process.

In another implementation, the method of making the touch fastener 10 may include the step of forming rotatable pivots 120 to join adjacent base segments 25 at the articulable joints 40. In one example, adjacent base segments 25 are joined to a link 130 at rotatable pivots 120.

Figure 33:
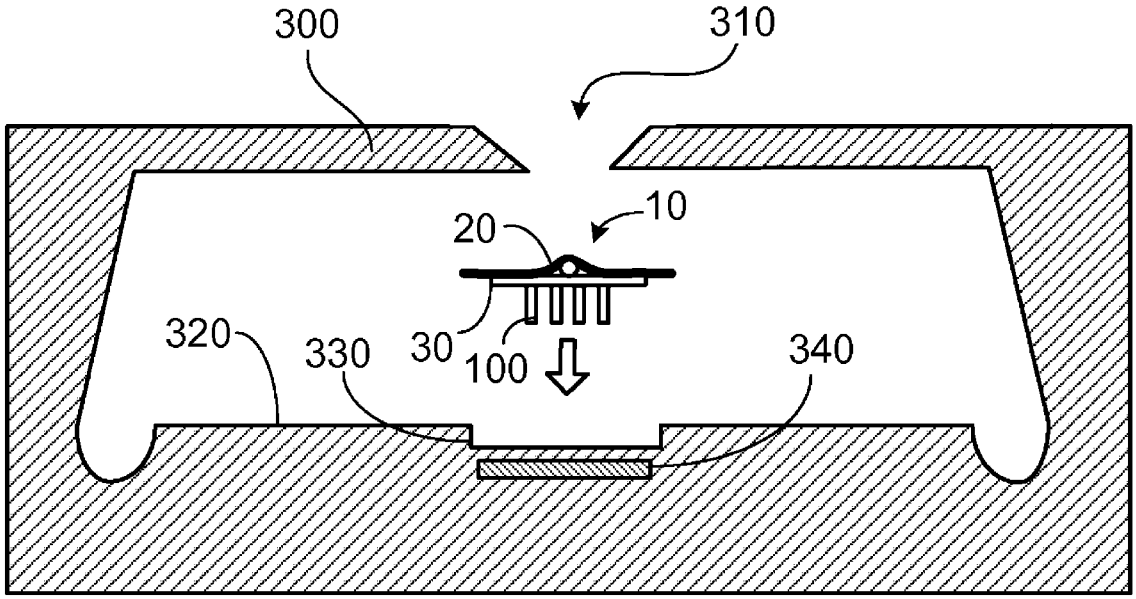
FIG. 33 is a cross-sectional view of a mold having a mold cavity for a seat and a touch fastener disposed in the mold cavity.

Referring to FIG. 33, a method of forming a seat foam bun includes providing a mold cavity 310, defined by a mold 300, having a shape corresponding to the shape of the seat foam bun, wherein the mold cavity 310 defines a trench 330 in a flat mold surface 320. Another step includes providing a touch fastener 10 that includes an elongated base 20 having multiple segments 25 connected by articulable joints 40, each segment 25 having upper and lower surfaces, 22 and 24 respectively, and a plurality of touch fastener elements 100 extending from the lower surface 24 of the base 20. A flexible barrier 30 is extended across at least one articulable joint 40 between adjacent base segments 25. Additionally, the touch fastener 10 is positioned along the trench 330 with the flexible barrier 30 in contact with a surface 320 of the mold cavity 310. Furthermore, a foamable resin is delivered into the mold cavity 310 to form a seat foam bun. The flexible barrier 30 resists intrusion of foamable resin into the plurality of the touch fastener elements 100 at the joints 40.

In some instances, as depicted in FIG. 33, a magnet 340 can be positioned in the mold 300 to position the touch fastener 10 in the trench 330 of the flat mold surface 320. With the fastener 10 so positioned, a foamable liquid resin 505 is poured into the mold cavity 310. An exothermic reaction occurs, causing the liquid resin to foam up to fill the cavity 310. The foam adheres or is otherwise secured to the fastener 10, which becomes a part of the surface of the foam bun 500 removed from the cavity 310.

Figure 34:
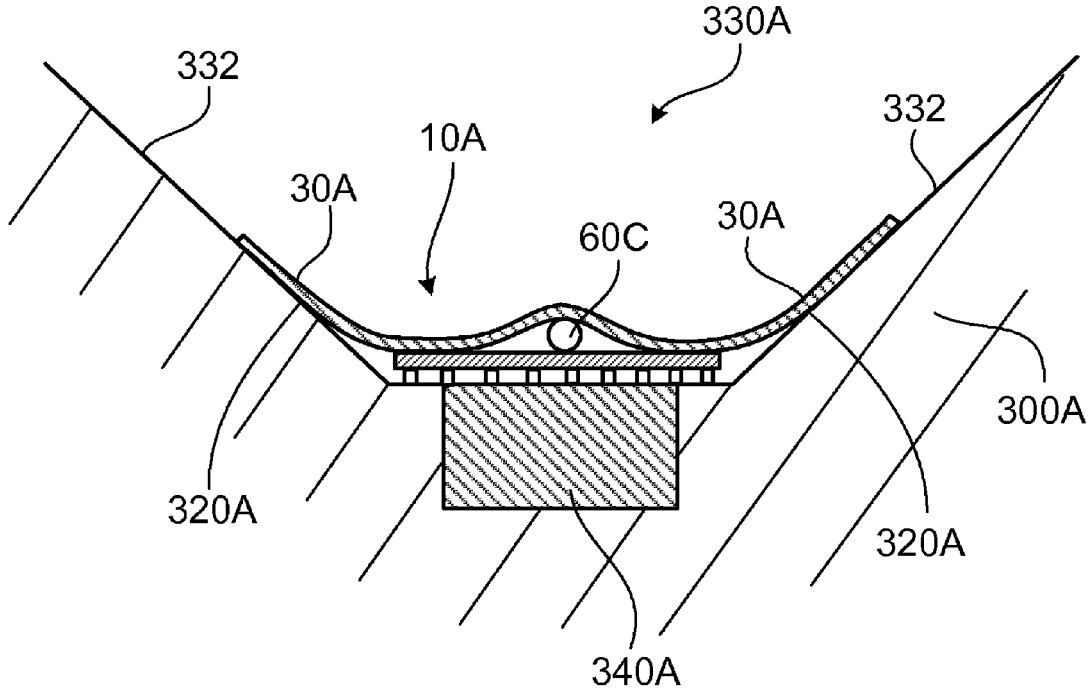
FIGS. 34-35 are cross-sectional views a touch fasteners positioned in molds.

FIG. 34 depicts a cross-sectional view of a touch fastener 10A positioned in a mold 300A. A magnet 340A is positioned below the trench 330A of the mold 300A, where the trench 330A has angled side portions 332. The force of magnetic attraction between the magnet 340A and the magnetically attractable wire 60C holds the touch fastener 10 in position against the surface of the mold trench 330A during foaming. During the molding process, the barrier 30A engages the mold surface 320A in face-to-face contact to prevent fouling of the fastener elements 100. Contact pressure between the barrier 30A and the mold wall is a function of the magnetic force applied to the wire 60C, and the bending stiffness of the barrier 30A.

Figure 35:
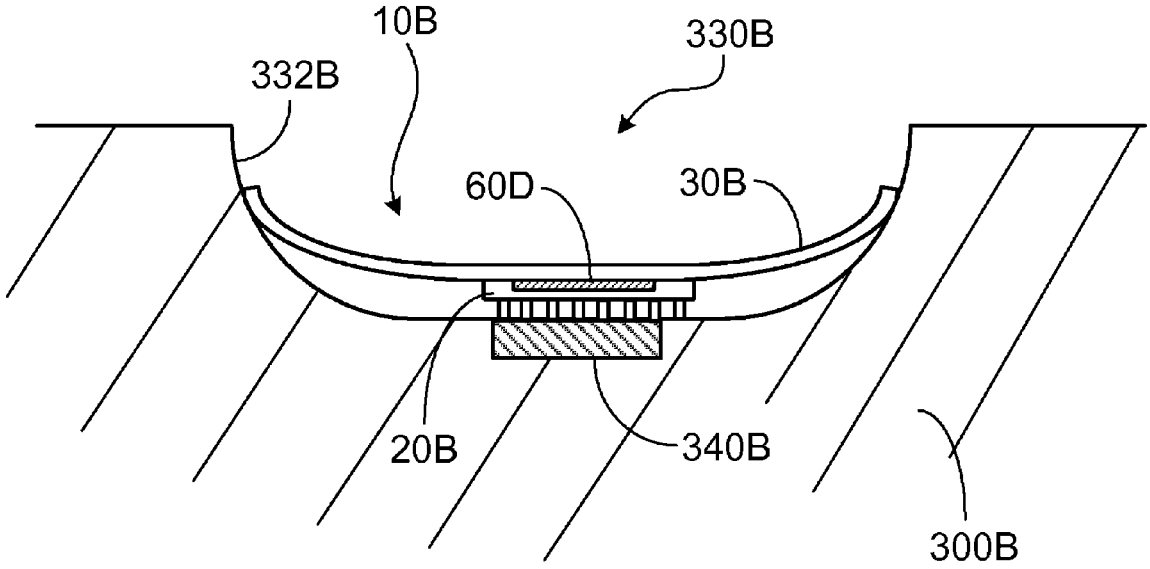
Figure 36:
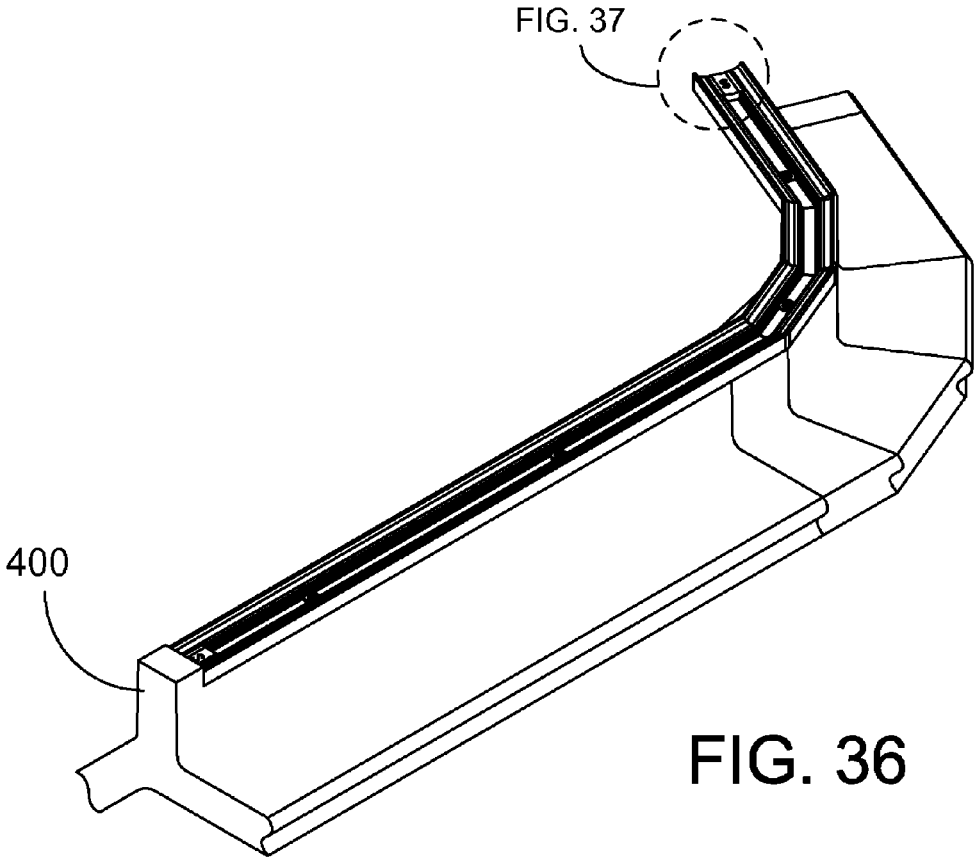
FIG. 36 is a partial perspective view of a mold with a pedestal configured to receive a touch fastener.
Figure 37:
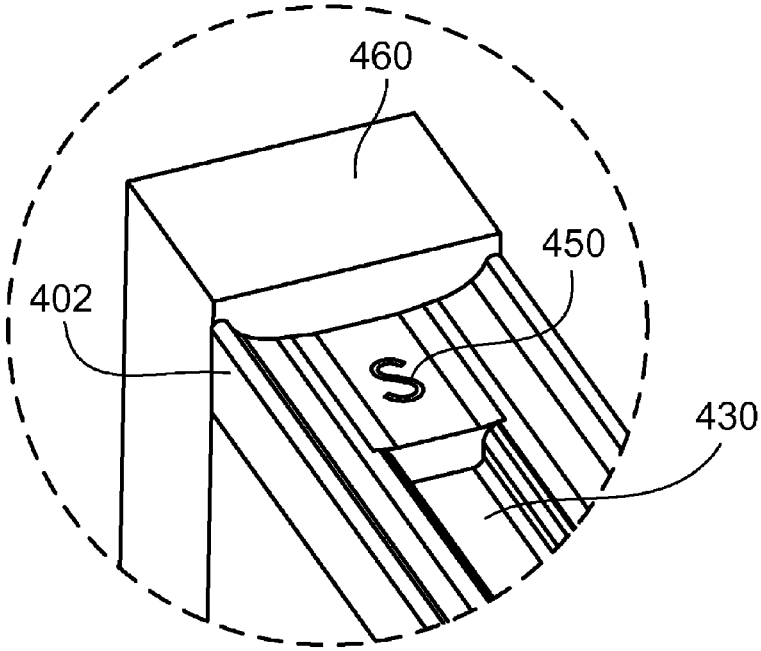
FIG. 37 is a detail perspective view of an end of the pedestal shown in FIG. 36.
Figure 38:
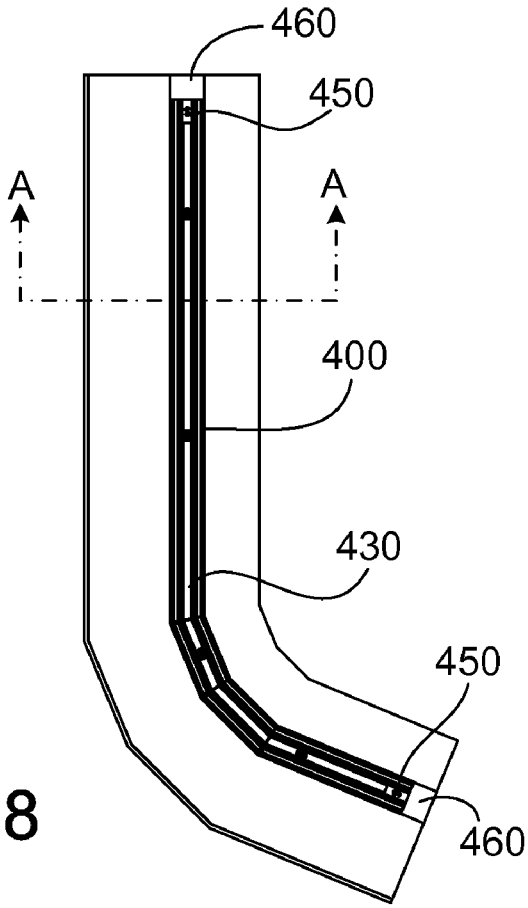
FIG. 38 is a top view of the mold with a pedestal shown in FIG. 36.
Figure 39:
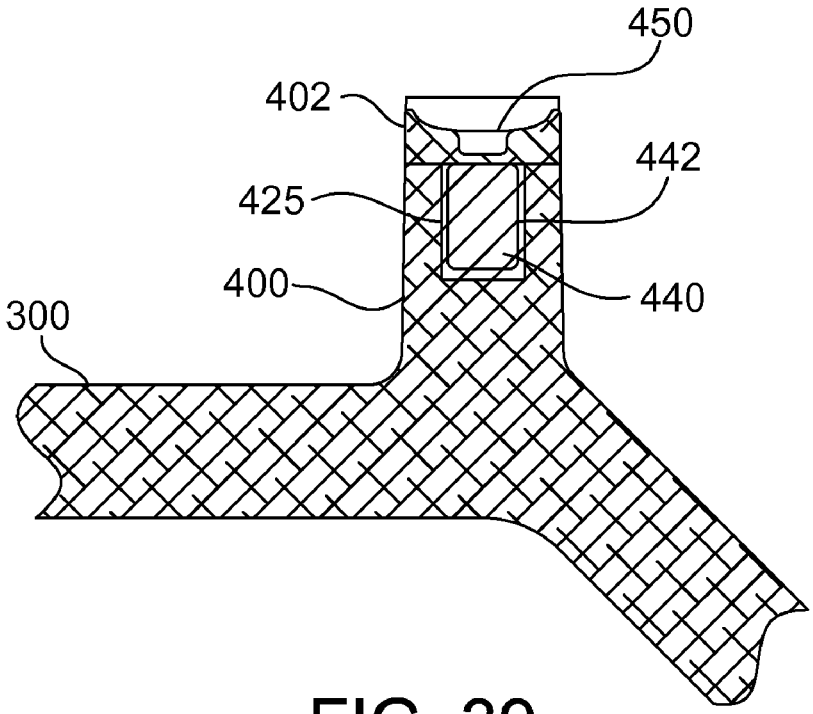
FIG. 39 is a section view of the mold with a pedestal shown in FIG. 38.

FIG. 35 shows another example of a tapered trench 330B, this one having arcuate side walls 332B that extend upward from the bottom of the trench 330B. The film barrier 30B is of such a width that lateral edges of the film 30B are deflected upward as the central portion of a fastener 10B is drawn against the bottom of the trench 330B. The illustrated fastener 10B includes a thin strip of magnetically attractable material 60D, instead of a wire, disposed within the central portion of the strip-form base 20B. The magnetically attractable strip 60D may be in the form of a shim, strip, or iron powder glue strip encapsulated in the base 20 as it is formed. For example, an iron powder glue strip may be introduced into the nip of a continuous fastener molding apparatus during formation of a fastener. The magnetically attractable strip 60D may also be snap fit or adhered to the base 20 after the base 20 is formed.

In the examples illustrated in FIGS. 36-39, the mold 300 (e.g. cast aluminum) includes a pedestal 400 that defines a fastener trench 430 configured to receive the touch fastener 10. In some implementations, the pedestal 400 defines a magnet trench 425 in a distal top portion that receives a magnet 440. A pedestal cap 402 is disposed over the magnet trench 425, enclosing the magnet 440 in the magnet trench 425. The magnet 440 may be fixed in the magnet trench 425 with an adhesive 442 (e.g. epoxy). The pedestal cap 402 defines the fastener trench 430. Once positioned in the fastener trench 430, the magnetically attractable material 60 in the fastener is attracted by the magnet 440 and pulled down into the fastener trench 430. An end magnet 450 is disposed in the fastener trench 430 and each longitudinal end of the trench 430. An end cap 460 closes off each end of the fastener trench 430.

Figure 40:
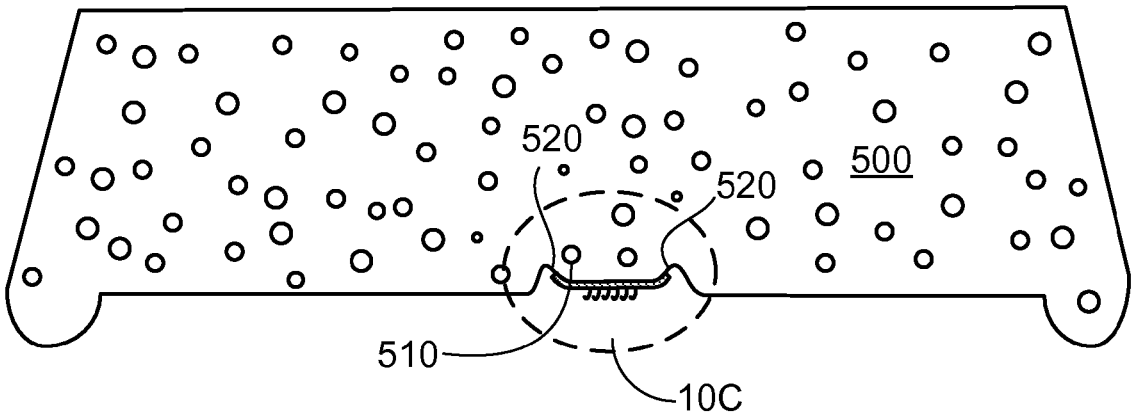
FIGS. 40-41 are cross-sectional views foam seat buns with touch fasteners.
Figure 41:
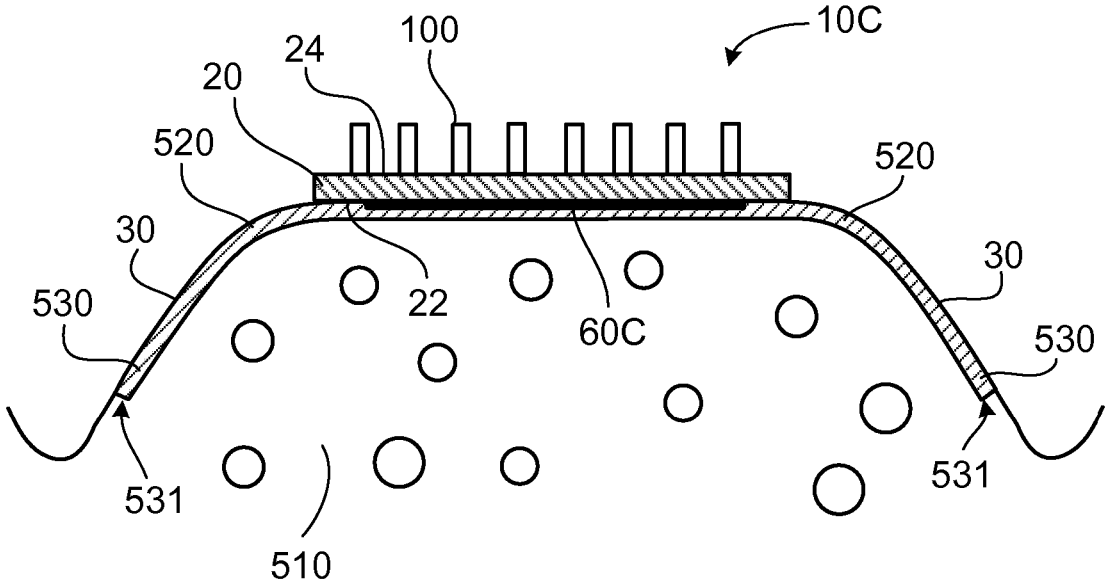

The touch fasteners 10 are molded into a seat foam bun 500, for example as depicted in FIGS. 40 and 41. The molded seat foam bun 500, depicted in FIG. 40, includes a trench portion 44, which includes a plateau 510 having lateral edges 520 and angled side walls 530. A touch fastener 10C is molded into the plateau 510 and extends across lateral edges 520 and along a portion of angled sides 530, such that the distal edges 531 of the fastener 10*c* are disposed out of the plane of the fastener element array, and directed down into the bun 500. The touch fastener 10*c* includes a base 20 having an upper face 22 and a lower face 24. Extending from the lower face 24 are fastener elements 100 having stems integrally molded thereto. A magnetically attractable strip 60 is adhered to the upper face 22 of the base 20 and a film barrier 30 covers the magnetically attractable strip 60 and expands beyond the lateral edges of the base 20. The barrier 30 is molded into the seat foam bun 500, creating a smooth surface on the lateral edges 520 and angled side 530 walls of the plateau 510.

Other examples of forming a touch fastener for use as a mold insert are described in U.S. patent application Ser. No. 10/791,204 to Line et al. entitled TOUCH FASTENER PRODUCTS; U.S. Provisional Patent Application No. 60/829,761 to Janzen et al. entitled FASTENER SYSTEMS FOR SEAT CUSHIONS; and U.S. Provisional Patent Application No. 60/829,822 to Line et al. entitled TOUCH FASTENER PRODUCTS, the entire disclosures of which are hereby incorporated herein by reference.

A number of implementations of the invention have been described. Nevertheless, it will be understood that various modifications may be made without departing from the spirit and scope of the invention. For example, the discrete barrier segments 35 are depicted in FIGS. 19-23 as circular. Nevertheless, discrete barrier segments 35 may also be square, hourglass, and other shapes. Accordingly, other implementations are within the scope of the following claims.

What is claimed is:

1. A touch fastener comprising:

an elongated base having multiple segments connected by articulable joints, each segment having upper and lower surfaces and a plurality of touch fastener elements extending from the lower surface of the base;

a flexible barrier extending across at least one articulable joint between adjacent base segments; and a magnetically attractable material disposed along a center region of the upper surface of the base.

2. The touch fastener of claim 1, wherein the base defines a pair of first and second notches in opposite longitudinal edges of the base at the articulable joint.

3. The touch fastener of claim 2, wherein the barrier defines a slit in through a longitudinal edge of the flexible barrier and aligned with one of the notches at the articulable joint.

4. The touch fastener of claim 1, further comprising multiple discrete barrier segments, each barrier segment extending across at least one respective articulable joint.

5. The touch fastener of claim 1, further comprising a flexible compressible gasket secured to the lower surface of the base.

6. A touch fastener comprising an elongated base having upper and lower surfaces, a plurality of touch fastener elements extending from the lower surface of the base, and a magnetically attractable material disposed along a center region of the upper surface of the base, wherein the base defines a series of spaced apart pairs of opposite notches in its longitudinal edges and forming respective articulable base joints, adjacent pairs of notches defining respective base segments therebetween;

wherein the notches are each sized with respect to an overall width of the base such that, when one of the articulable joints is flexed to close one of its corresponding notches, the other of its corresponding notches opens only to a longitudinal gap dimension less than about 0.5 millimeter.

7. The touch fastener of claim 6, further comprising a flexible barrier extending across at least one articulable joint between adjacent base segments.

8. The touch fastener of claim 6, wherein the base defines a pair of first and second notches in opposite longitudinal edges of the base at the articulable joint.

9. The touch fastener of claim 6, further comprising a barrier extending across at least one articulable joint between adjacent base segments, the barrier defines a slit in through a longitudinal edge of the flexible barrier and aligned with one of the notches at the articulable joint.

10. The touch fastener of claim 6, further comprising multiple discrete barrier segments, each barrier segment extending across at least one respective articulable joint.

11. A touch fastener comprising:

an elongated base having multiple segments connected by articulable joints, each segment having upper and lower surfaces and a plurality of touch fastener elements extending from the lower surface of the base; and a flexible barrier extending across at least one articulable joint between adjacent base segments;

wherein the base defines a pair of first and second notches in opposite longitudinal edges of the base at the articulable joint, and the barrier defines a slit in through a longitudinal edge of the flexible barrier and aligned with one of the notches at the articulable joint.

12. A touch fastener comprising:

an elongated base having multiple segments connected by articulable joints, each segment having upper and lower surfaces and a plurality of touch fastener elements extending from the lower surface of the base;

a flexible barrier extending across at least one articulable joint between adjacent base segments; and multiple discrete barrier segments, each barrier segment extending across at least one respective articulable joint.

13. A touch fastener comprising:

an elongated base having multiple segments connected by articulable joints, each segment having upper and lower surfaces and a plurality of touch fastener elements extending from the lower surface of the base;

a flexible barrier extending across at least one articulable joint between adjacent base segments; and a flexible compressible gasket secured to the lower surface of the base.

14. A touch fastener comprising:

an elongated base having upper and lower surfaces and a plurality of touch fastener elements extending from the lower surface of the base, wherein the base defines a series of spaced apart pairs of opposite notches in its longitudinal edges and forming respective articulable base joints, adjacent pairs of notches defining respective base segments therebetween; and a barrier extending across at least one articulable joint between adjacent base segments, the barrier defines a slit in through a longitudinal edge of the flexible barrier and aligned with one of the notches at the articulable joint;

wherein the notches are each sized with respect to an overall width of the base such that, when one of the articulable joints is flexed to close one of its corresponding notches, the other of its corresponding notches opens only to a longitudinal gap dimension less than about 0.5 millimeter.

15. A touch fastener comprising:

an elongated base having upper and lower surfaces and a plurality of touch fastener elements extending from the lower surface of the base, wherein the base defines a series of spaced apart pairs of opposite notches in its longitudinal edges and forming respective articulable base joints, adjacent pairs of notches defining respective base segments therebetween; and multiple discrete barrier segments, each barrier segment extending across at least one respective articulable joint;

wherein the notches are each sized with respect to an overall width of the base such that, when one of the articulable joints is flexed to close one of its corresponding notches, the other of its corresponding notches opens only to a longitudinal gap dimension less than about 0.5 millimeter.

* * * * *